US012378720B2

(12) United States Patent
Youk et al.

(10) Patent No.: US 12,378,720 B2
(45) Date of Patent: Aug. 5, 2025

(54) CLOTHES FOLDING MACHINE

(71) Applicant: LG Electronics Inc., Seoul (KR)

(72) Inventors: Hyungkyu Youk, Seoul (KR); Sanghun Bae, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/710,362

(22) PCT Filed: Nov. 7, 2022

(86) PCT No.: PCT/KR2022/017373
§ 371 (c)(1),
(2) Date: May 15, 2024

(87) PCT Pub. No.: WO2023/090740
PCT Pub. Date: May 25, 2023

(65) Prior Publication Data

US 2025/0012001 A1 Jan. 9, 2025

(30) Foreign Application Priority Data

Nov. 16, 2021 (KR) ..... 10-2021-0157459

(51) Int. Cl.
*D06F 89/00* (2006.01)
*D06F 89/02* (2006.01)

(52) U.S. Cl.
CPC ..... *D06F 89/02* (2013.01)

(58) Field of Classification Search
CPC ..... D06F 89/00; D06F 89/02
USPC ..... 493/441, 418, 440, 458; 223/39
See application file for complete search history.

(56) References Cited

U.S. PATENT DOCUMENTS 3,310,207 A * 3/1967 Gore ..... D06G 3/02 223/39
2021/0363686 A1* 11/2021 Lim ..... D06F 89/02

FOREIGN PATENT DOCUMENTS

| | | | | |
|---|---|---|---|---|
| CN | 111996771 | | 11/2020 | |
| CN | 113371526 | | 8/2021 | |
| JP | 4007517 | | 11/2007 | |
| JP | 5881539 | | 3/2016 | |
| JP | 2013252295 | * | 3/2016 | ..... D06F 89/02 |
| KR | 10-2020-0028826 | | 3/2020 | |

OTHER PUBLICATIONS

International Search Report and Written Opinion in International Appln. No. PCT/KR2022/017373, mailed on Feb. 27, 2023, 8 pages (with partial English translation).

* cited by examiner

*Primary Examiner* — Jacob A Smith
(74) *Attorney, Agent, or Firm* — Fish & Richardson P.C.

(57) ABSTRACT

The present disclosure relates to a garment folding machine including a housing, a loading unit into which a garment is loaded, and a folding unit configured to transfer and fold the loaded garment, in which the folding unit includes a first conveyor configured to transfer the garment from an upper side toward a lower side based on a gravitational direction, a second conveyor disposed below the first conveyor and having a rear end changeable in height, and a folding plate disposed rearward of the second conveyor and configured to fold the garment while rotating, thereby folding the garment with a small number of conveyor belts by changing rotation directions of the conveyor belts during the process of transferring the garment.

13 Claims, 19 Drawing Sheets

CLOTHES FOLDING MACHINE

CROSS-REFERENCE TO RELATED APPLICATIONS

This application is a National Stage application under 35 U.S.C. § 371 of International Application No. PCT/KR2022/017373, filed on Nov. 7, 2022, which claims the benefit of Korean Application No. 10-2021-0157459, filed on Nov. 16, 2021. The disclosures of the prior applications are incorporated by reference in their entirety.

TECHNICAL FIELD

The present disclosure relates to a garment folding machine, and more particularly, to a garment folding machine capable of maximizing spatial efficiency.

BACKGROUND ART

Garments are made of soft materials such as natural fibers or synthetic fibers and need to be folded to appropriate sizes and shapes so that the garments are stored and carried.

Usually, it is necessary to perform a process of folding the garments significantly often or perform a process of folding a large quantity of garments in order to accommodate the garments after washing the garments or to store the garments for a long period of time in accordance with a change in season. However, a process of manually and directly folding the garments causes a waste of time and resources. In a case in which the garments are folded by unskilled persons, the shapes and the sizes of the folded garments are not uniform, which causes a problem in that additional labor is required to fold the garments for the purpose of displaying or storing the garments.

Therefore, there is a gradually increasing need for an automatic folding machine capable of quickly folding a garment without variation.

Regarding the garment folding machine in the related art, International Patent Publication No. 2018-122841 (hereinafter, referred to as a 'related art document') discloses a configuration of a folding machine in which a garment is loaded from above, folded, and then discharged while moving downward and passing through a plurality of folding layers stacked in multiple stages.

However, in the case of the folding machine disclosed in the related art document, lower garments, which have long lengths among garments C, towels, or bedclothes are conveyed along the two or more folding layers and may be wrinkled during the conveying process.

In particular, in the case of the domestic garment folding machine as disclosed in the related art document, the plurality of layers is vertically disposed in a narrow horizontal area due to a spatial restriction, spaces between the layers are narrow, and many components are provided to convey the garments between the layers. For this reason, the garment C is easily wrinkled during the process of conveying the garment C.

Meanwhile, Japanese Patent Application Laid-Open No. 1995-284599A (Oct. 31, 1995) discloses a garment folding apparatus equipped with a plurality of conveyor belts.

The garment folding apparatus is configured to fold a garment by rotating the plurality of conveyor belts forward or reversely.

However, because the garment folding apparatus disclosed in the related art document is equipped with ten conveyor belts, there is a limitation in that the conveyor belts occupy a large volume, and a large amount of electric power is required to operate the conveyor belts.

Therefore, there is a need to provide a garment folding machine and a method of controlling the garment folding machine, which are capable of maximizing space efficiency and preventing the garment from being wrinkled and crumpled during the process of conveying the garment.

DISCLOSURE

Technical Problem

The present disclosure has been made in an effort to solve the above-mentioned problems with the garment folding machine in the related art, and an object of the present disclosure is to provide a garment folding machine capable of preventing a garment from being wrinkled and creased during a process of transferring the garment.

The present disclosure has also been made in an effort to provide a garment folding machine capable of folding a garment to an appropriate length in accordance with a length of the garment.

Technical Solution

In order to achieve the above-mentioned objects, the present disclosure provides a garment folding machine including: a housing; a loading unit into which a garment is loaded; and a folding unit configured to transfer and fold the loaded garment, in which the folding unit includes: a first conveyor configured to transfer the garment from an upper side toward a lower side based on a gravitational direction; a second conveyor disposed below the first conveyor and having a rear end changeable in height; and a folding plate disposed rearward of the second conveyor and configured to fold the garment while rotating.

In this case, the loading unit may include: a loading plate onto which the garment is loaded; and a loading conveyor provided above the loading plate and configured to transfer the garment rearward while rotating.

In this case, a speed at which the first conveyor transfers the garment may be higher than a speed at which the loading conveyor transfers the garment.

A folding gap with a predetermined interval may be formed between the first conveyor and the second conveyor, and a distance of the folding gap may be smaller than a thickness of the garment.

The second conveyor may transfer the garment forward, and the garment may be transferred rearward when the garment is moved to a predetermined direction change position.

The rear end of the second conveyor may be rotated and moved downward when the garment is moved to the direction change position.

The folding unit may include a third conveyor disposed rearward of the second conveyor and configured to transfer the garment having passed over the second conveyor.

In this case, a front end of the third conveyor may be rotated and moved downward after the folding plate is rotated.

The garment folding machine may further include: a control unit configured to control the loading unit and the folding unit.

In this case, the loading unit may include: a loading conveyor motor configured to provide driving power for operating the loading conveyor; and a garment input detection sensor disposed rearward of the loading plate and configured to detect the garment, and the control unit may operate the loading conveyor motor when the garment input detection sensor detects the garment.

In addition, the folding unit may include: a first conveyor sensor disposed on the first conveyor and configured to detect the garment; and a second conveyor motor configured to provide driving power for operating the second conveyor, and the control unit may operate the second conveyor motor when the first conveyor sensor detects the garment.

In addition, the folding unit may include: a second conveyor motor configured to provide driving power for operating the second conveyor; and a second conveyor sensor disposed on the second conveyor and configured to detect the garment, and the control unit may change a rotation direction of the second conveyor motor when the second conveyor sensor detects the garment.

In addition, the folding unit may further include a second conveyor movement motor configured to rotate the second conveyor to rotate the rear end of the second conveyor, and the control unit may operate the second conveyor movement motor when the second conveyor sensor detects the garment.

Advantageous Effects

According to the garment folding machine according to the present disclosure described above, it is possible to fold the garment with a small number of conveyor belts by changing the rotation directions of the conveyor belts during the process of transferring the garment.

In addition, it is possible to calculate the length of the garment while transferring the garment and fold the garment to an appropriate length in accordance with the length of the garment.

DESCRIPTION OF DRAWINGS

FIG. 2 is viewed at another angle.

FIG. 2 is viewed at another angle.

MODE FOR INVENTION

Figure 1:
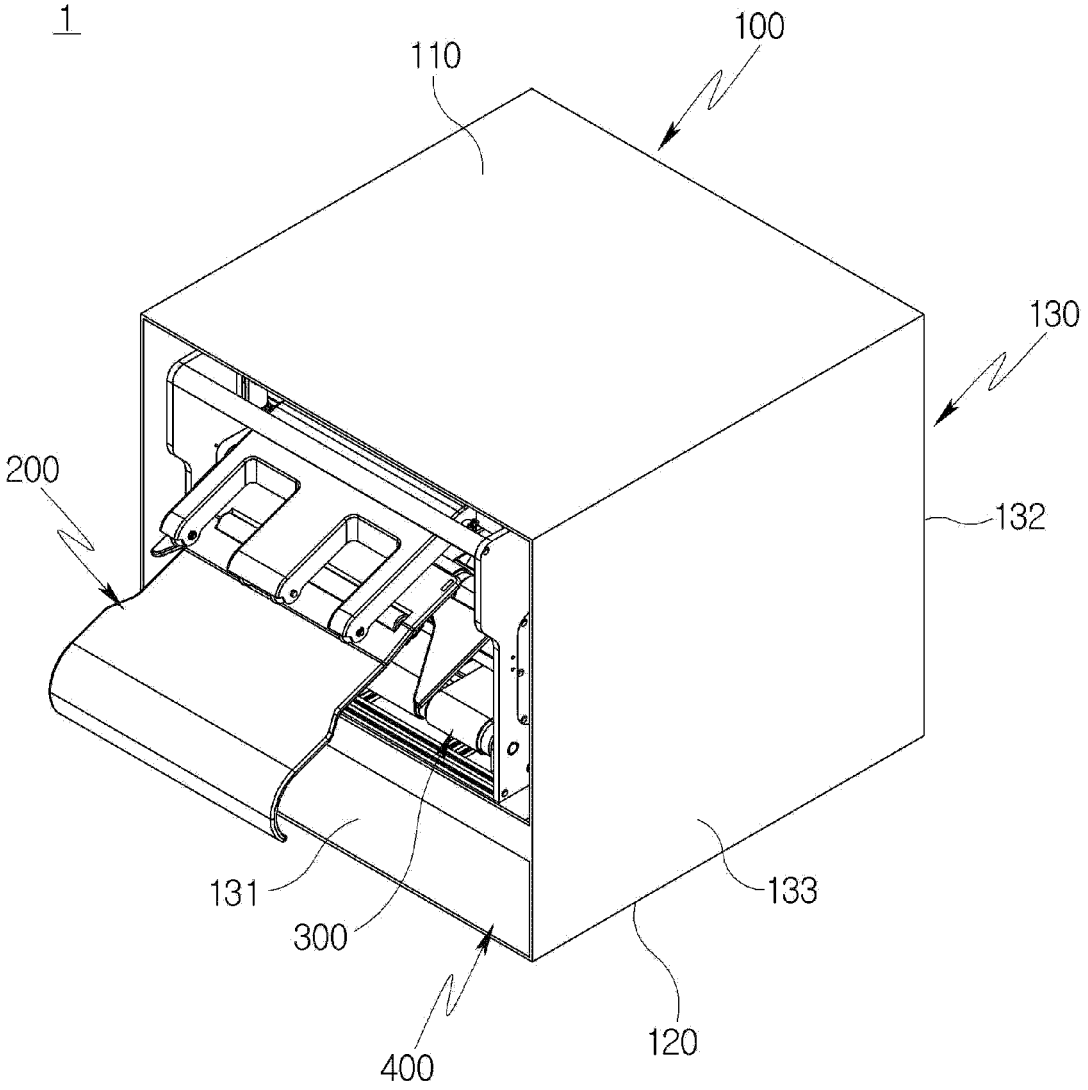
FIG. 1 is a schematic configuration view illustrating a basic configuration of a garment folding machine according to the present disclosure.
Figure 2:
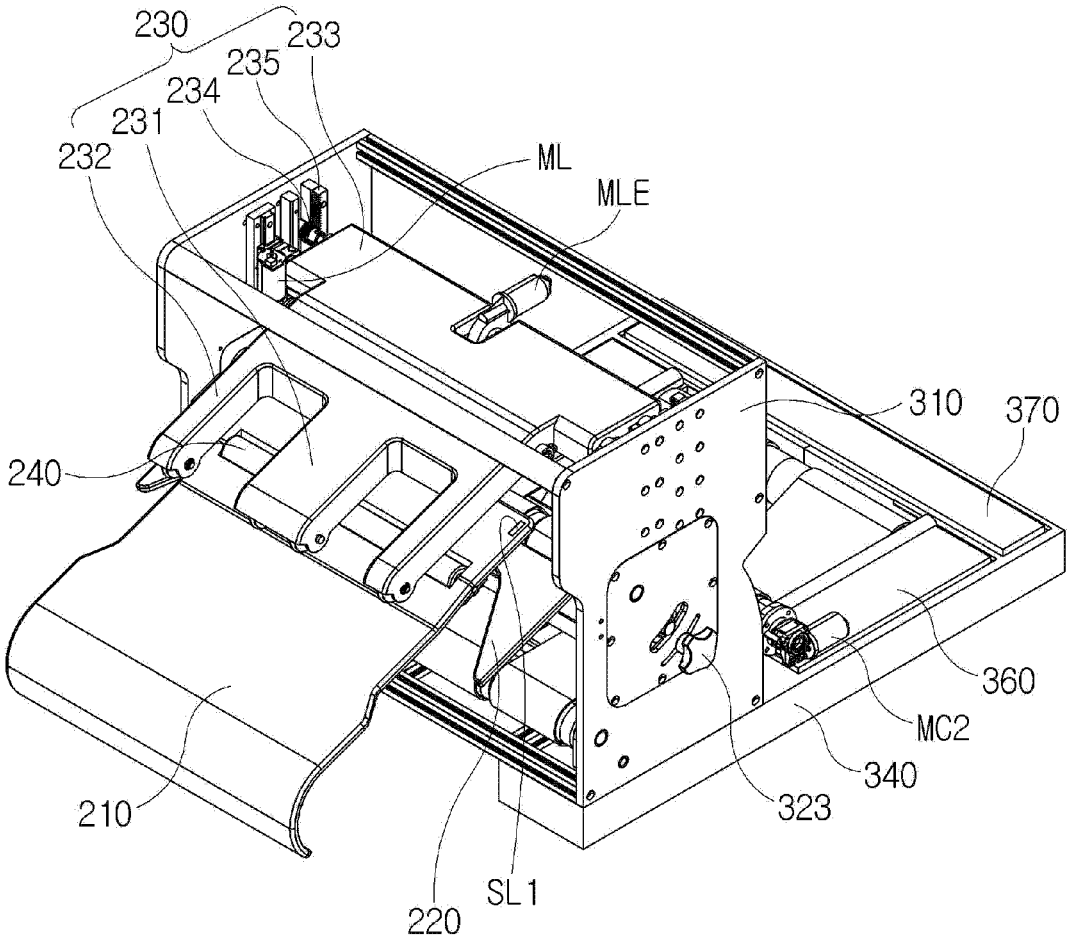
FIG. 2 is a view illustrating a state in which a housing in FIG. 1 is excluded.
Figure 3:
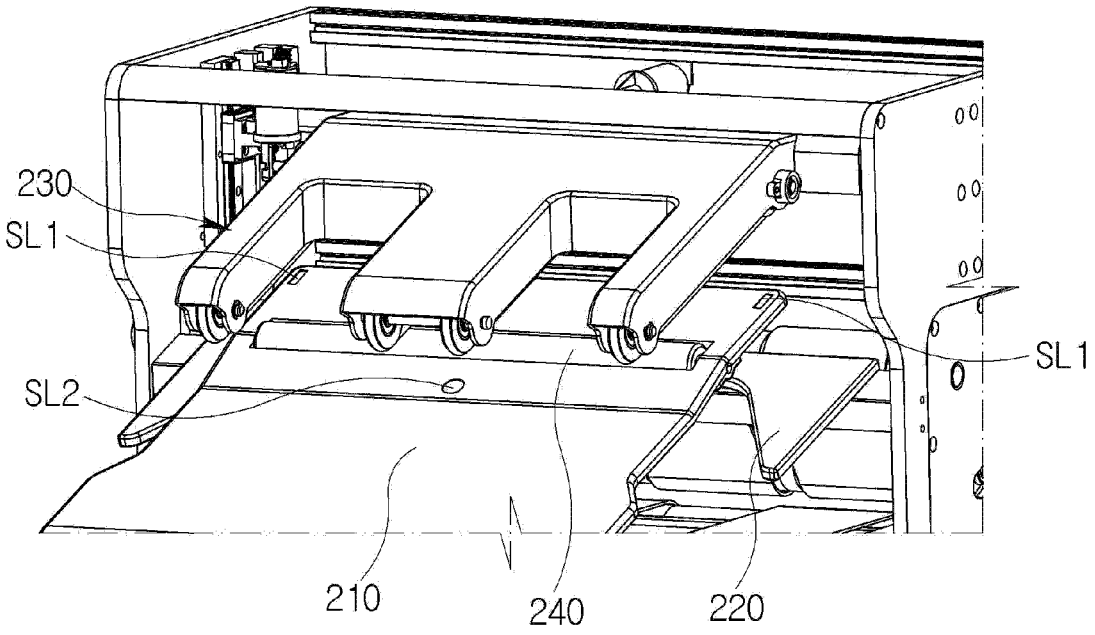
FIG. 3 is a view for explaining a sensor position in a loading unit in FIG. 2.
Figure 4:
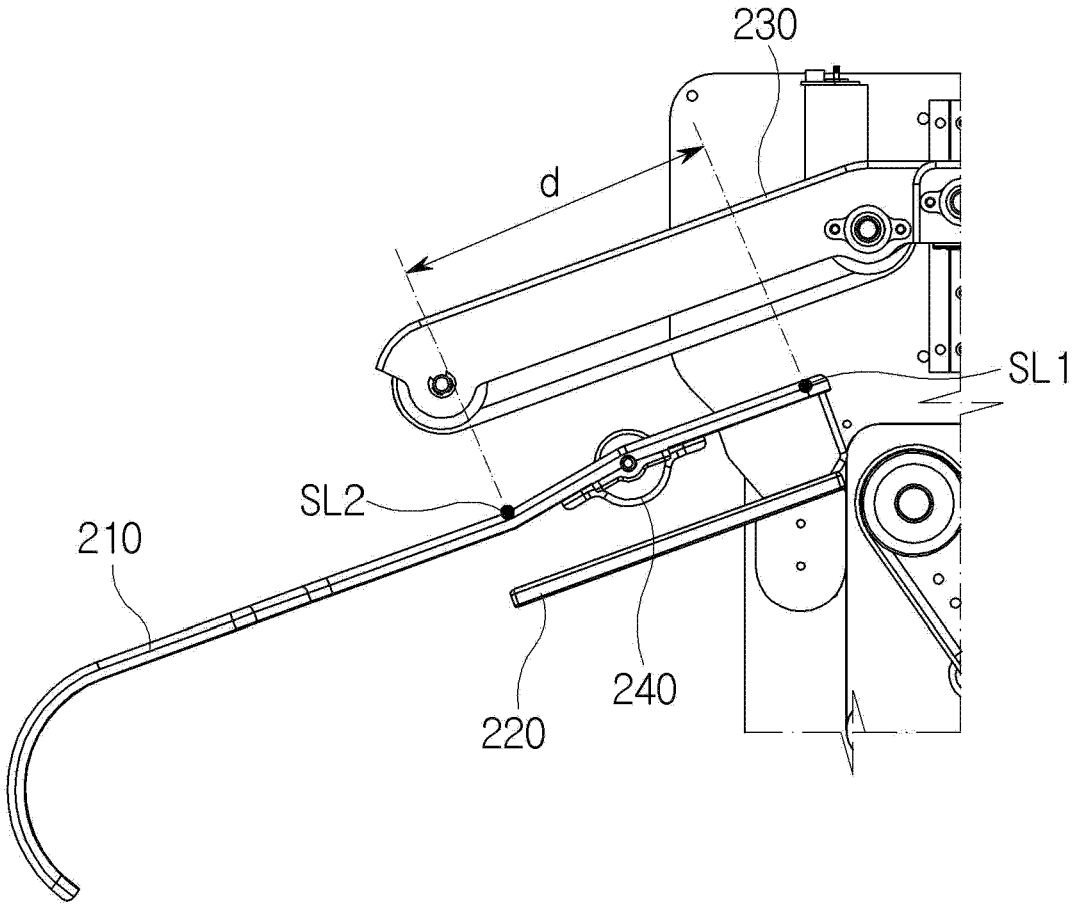
FIG. 4 is a side view for explaining the arrangement of the loading unit in FIG. 2.
Figure 5:
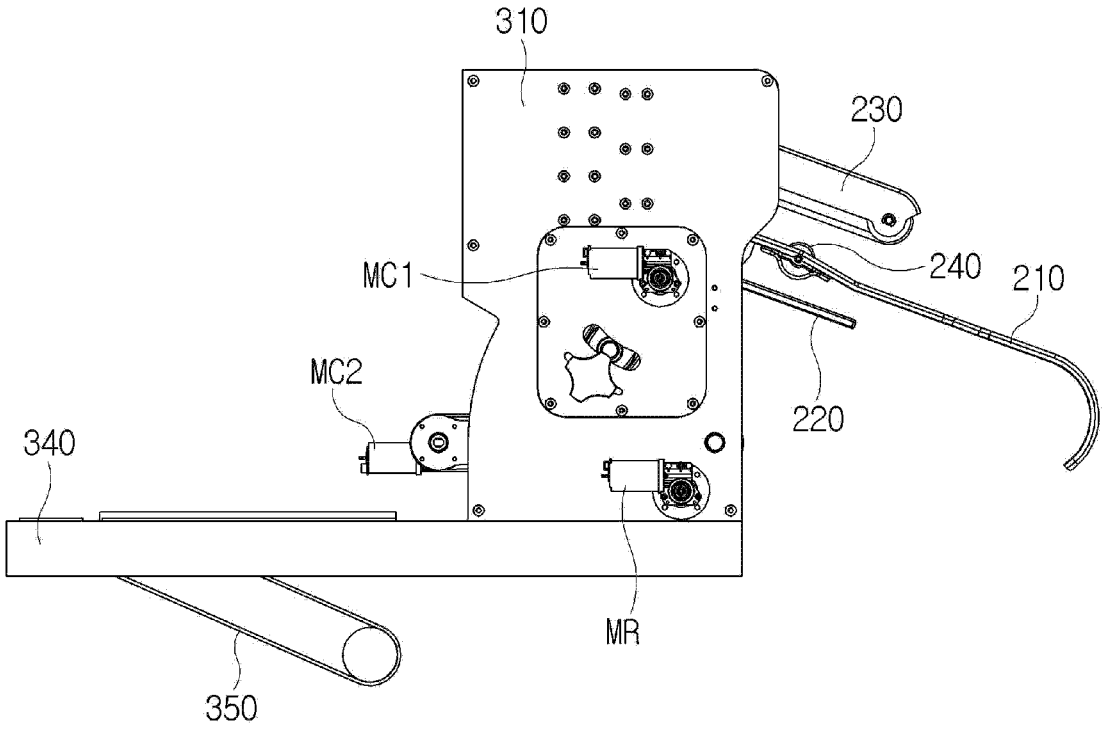
FIG. 5 is a side view when
Figure 6:
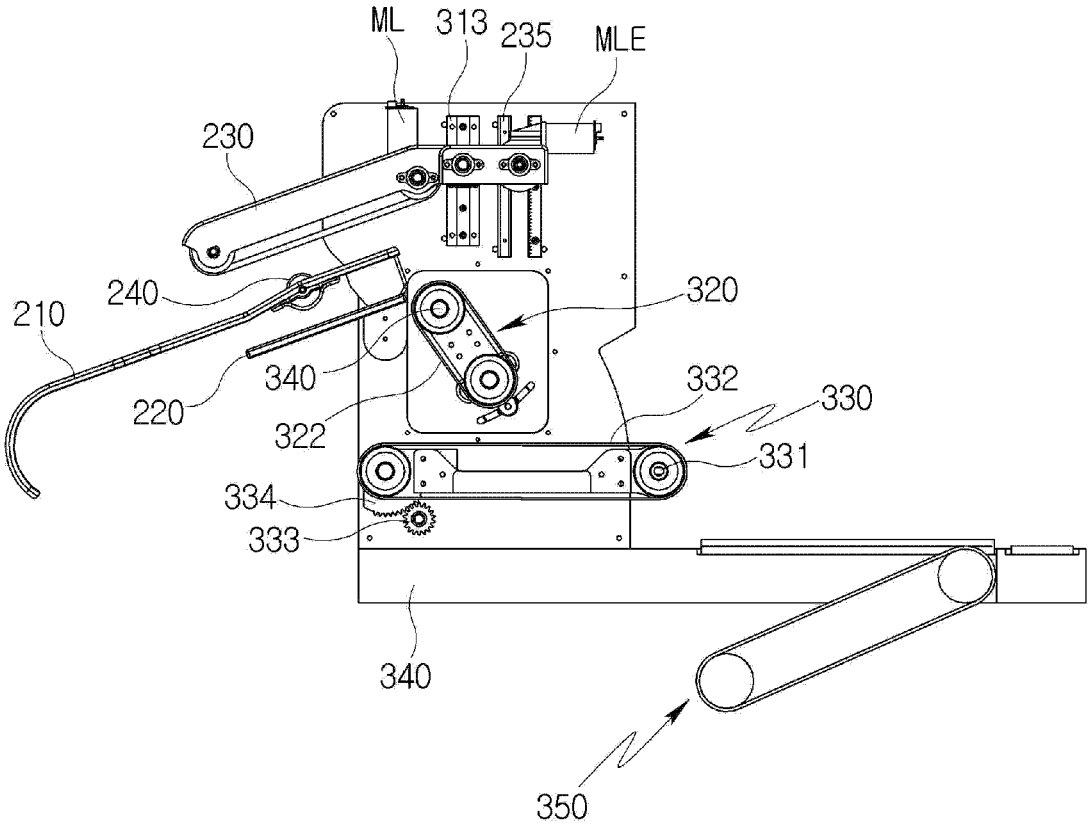
FIG. 6 is a view for explaining a structure of a folding unit in FIG. 2 in a state in which a lateral plate is excluded.
Figure 7:
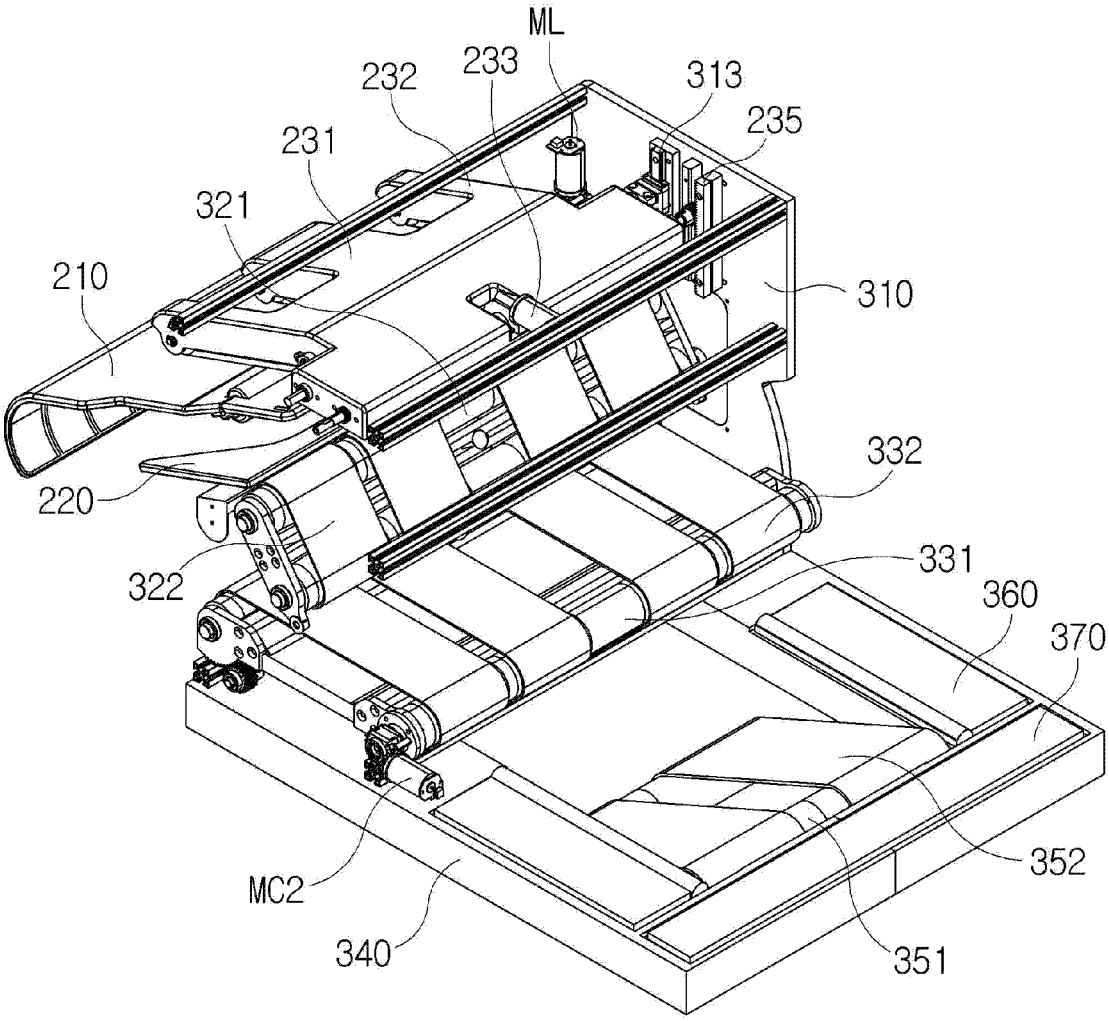
FIG. 7 is a perspective view when

Hereinafter, exemplary embodiments of the present disclosure will be described in detail with reference to the accompanying drawings.

The present disclosure may be variously modified and may have various embodiments, and particular embodiments illustrated in the drawings will be specifically described below. The description of the embodiments is not intended to limit the present disclosure to the particular embodiments, but it should be interpreted that the present disclosure is to cover all modifications, equivalents and alternatives falling within the spirit and technical scope of the present disclosure.

In the description of the present disclosure, the terms such as "first" and "second" may be used to describe various constituent elements, but the constituent elements may not be limited by the terms. These terms are used only to distinguish one constituent element from another constituent element. For example, a first component may be named a second component, and similarly, the second component may also be named the first component, without departing from the scope of the present disclosure.

The term "and/or" may include any and all combinations of a plurality of the related and listed items.

When one constituent element is described as being "coupled" or "connected" to another constituent element, it should be understood that one constituent element can be coupled or connected directly to another constituent element, and an intervening constituent element can also be present between the constituent elements. When one constituent element is described as being "coupled directly to" or "connected directly to" another constituent element, it should be understood that no intervening constituent element is present between the constituent elements.

The terminology used herein is used for the purpose of describing particular embodiments only and is not intended to limit the present disclosure. Singular expressions may include plural expressions unless clearly described as different meanings in the context.

The terms "comprises," "comprising," "includes," "including," "containing," "has," "having" or other variations thereof are inclusive and therefore specify the presence of stated features, integers, steps, operations, elements, components, and/or combinations thereof, but do not preclude the presence or addition of one or more other features, integers, steps, operations, elements, components, and/or combinations thereof.

Unless otherwise defined, all terms used herein, including technical or scientific terms, may have the same meaning as commonly understood by those skilled in the art to which the present disclosure pertains. The terms such as those defined in a commonly used dictionary may be interpreted as having meanings consistent with meanings in the context of related technologies and may not be interpreted as ideal or excessively formal meanings unless explicitly defined in the present application.

Further, the following embodiments are provided to more completely explain the present disclosure to those skilled in the art, and shapes and sizes of elements illustrated in the drawings may be exaggerated for a more apparent description.

FIGS. 1 to 7 are views for explaining a garment folding machine according to an embodiment of the present disclosure.

Hereinafter, a garment folding machine 1 according to the present disclosure will be described with reference to FIGS. 1 to 7.

With reference to FIGS. 1 to 7, the garment folding machine 1 according to the present disclosure includes a housing 100 that defines an external appearance of the garment folding machine 1.

The housing 100 may accommodate a loading unit 200, a folding unit 300, and an unloading unit 400 in the garment folding machine 1 and define a minimum operating space of the garment folding machine 1. The housing 100 may stably support several members that constitute the garment folding machine 1. For example, the housing 100 may be formed in a hexahedral shape opened at one side thereof, such that a part of the loading unit 200 may be exposed to the outside. Another side of the housing 100 may be openable by a door (not illustrated) or the like and communicate with the unloading unit 400.

An upper surface 110 of the housing 100 may be horizontally disposed at an upper end of the garment folding machine 1, and an upper operating space of the garment folding machine 1 may be defined by the upper surface 110 of the housing 100.

A lower surface 120 of the housing 100 may be horizontally disposed at a lower end of the garment folding machine 1 and support the garment folding machine 1 on a floor surface. A lower operating space of the garment folding machine 1 may be defined by the lower surface 120.

A plurality of lateral surfaces 130 of the housing 100 may be vertically disposed to connect the upper surface 110 and the lower surface 120. The loading unit 200 and the folding unit 300, which will be described below may be mounted and supported on the plurality of lateral surfaces.

Meanwhile, a space inside the lateral surfaces may also be defined as a space in which folding and unloading processes are performed.

For example, based on horizontal frames 340 to be described below, the folding process is performed on the garment in an upper space of the horizontal frame 340 based on a gravitational direction, and the unloading process may be performed on the garment in a lower space of the horizontal frames 340 based on the gravitational direction.

Meanwhile, the lateral surfaces of the housing 100 may include a first lateral surface 131 on which the loading unit 200, into which the garment is inputted, is disposed, a second lateral surface 132 disposed at a position facing the first lateral surface 131, and third and fourth lateral surfaces 133 and 134 configured to connect the first lateral surface 131 and the second lateral surface 132.

Meanwhile, in order to understand the present disclosure, directions in the present disclosure are defined. A direction in which the first lateral surface 131, into which the garment is inputted, is disposed may be defined as forward and front sides of the garment folding machine 1, and a direction in which the second lateral surface 132 facing the first lateral surface 131 is disposed may be defined as rearward and rear sides of the garment folding machine 1. In addition, based on a direction in which the first lateral surface 131 is viewed from the second lateral surface 132, a right side may be defined as a right side, and a left side may be defined as a left side.

The loading unit 200 serves to load the garment. The loading unit 200 serves to load the garment, which is inputted along a loading plate 210, into the folding unit 300.

In this case, the garments not only mean upper garments manufactured by using natural fibers or synthetic fibers so as to be worn by persons, but also include all products such as lower garments, towels or bedclothes that may be provided by being folded to have desired sizes and thicknesses by the garment folding machine 1.

The loading unit 200 includes the loading plate 210, guide plates 220, a loading conveyor 230, a roller 240, a loading conveyor motor ML, a garment input detection sensor SL1, and a garment length calculation sensor SL2.

The loading plate 210 may serve to guide the garment so that the garment is loaded into the housing 100. For example, the loading plate 210 may have a plate shape having a front end including a curved surface. With this configuration, when the garment is placed on the loading plate 210, a rear end of the garment may sag downward by gravity. The garment gently sags along the curved surface of the loading plate 210, which may prevent the garment from being wrinkled.

The guide plate 220 may serve to guide a sleeve portion of the garment so that the sleeve portion of the garment is folded during the process of loading the garment. For example, the guide plates 220 may be provided as a pair of guide plates 220 disposed at two opposite sides of a rear side of the loading plate 210, and the pair of guide plates 220 may be disposed below the rear side of the loading plate 210. The guide plate 220 may be formed in a plate shape having a width that increases from a front end toward a rear end thereof. In this case, the width of the guide plate 220 may increase toward the inside of the loading plate 210. That is, the widths of the pair of guide plates 220 may increase in a shape in which an interval between the pair of guide plates 220 decreases.

With this configuration, when the garment is placed on the loading plate 210, the sleeve of the garment sags downward from the loading plate 210. When the garment moves rearward along the loading plate 210, the sleeve of the garment comes into contact with the guide plate 220 and is folded toward the inside of the garment.

The loading conveyor 230 may serve to transfer the garment, which is placed on the loading plate 210, to the folding unit 300. The loading conveyor 230 may be connected to the loading conveyor motor ML and receive driving power.

For example, the loading conveyor 230 may include a belt and a conveyor shafts, and the conveyor shafts may be connected to the loading conveyor motor ML through gears.

Meanwhile, in the present embodiment, the loading conveyor 230 may include a first loading conveyor 231 and second loading conveyors 232. In this case, the second loading conveyors 232 may be respectively disposed at two opposite sides of the first loading conveyor 231. The first loading conveyor 231 may have a larger width than the second loading conveyor 232. With this configuration, the first loading conveyor 231 may come into contact with a central portion of the garment, and the second loading conveyors 232 may come into contact with two opposite ends of the garment based on a width direction, thereby stably transferring the garment and preventing the garment from being wrinkled during the transfer process.

When the loading conveyor motor ML operates, the conveyor shafts may rotate by receiving the driving power from the loading conveyor motor ML, and the belt of the loading conveyor 230 may transfer the garment while being circulated by the rotations of the conveyor shafts.

The loading conveyor 230 may be provided on lateral plates 310 to be described below. The loading conveyor 230 may be provided on the lateral plates 310 and configured to be movable vertically. For example, the loading conveyor 230 includes a conveyor connection body 233, a loading conveyor movement motor MLE, movement gears 234, and rack gears 235. In this case, the conveyor connection body 233 may be coupled to the first loading conveyor 231 and the second loading conveyors 232 and have a gear (not illustrated) therein. The conveyor connection body 233 may connect the movement gears 234 and a shaft of the loading conveyor movement motor MLE. The movement gear 234 may be connected to the shaft of the loading conveyor movement motor MLE. The movement gear 234 rotates when the loading conveyor movement motor MLE operates. The rack gear 235 is fixedly coupled to the lateral plate 310 and engages with the movement gear 234. Therefore, when the movement gear 234 rotates, the loading conveyor 230 may vertically move along the rack gear 235. With this configuration, the loading conveyor 230 may adjust an interval between the loading plate 210 and the loading conveyor 230 in accordance with a thickness of the garment.

Meanwhile, in the present disclosure, the loading conveyor 230 may be disposed above the loading plate 210. Further, the belt of the loading conveyor 230 may come into contact with an upper surface of the garment placed on the loading plate 210 and transfer the garment toward the rear side of the garment folding machine 1 when the loading conveyor motor ML operates.

Meanwhile, the garment input detection sensor SL1 may be disposed on the loading plate 210. The garment input detection sensor SL1 may detect whether the garment is placed on the loading plate 210 and loaded into the housing 100. For example, the garment input detection sensor SL1 serves to detect whether a garment C is present in an effective detection range. The garment input detection sensor SL1 is a digital sensor that outputs an ON-signal when the garment C is present in the effective detection range, and outputs an OFF-signal when the garment C is not present in the effective detection range. In the embodiment according to the present disclosure, a contactless IR (infrared ray) sensor may be applied, for example, but the present disclosure is not limited thereto.

With this configuration, when the garment is inputted, the garment input detection sensor SL1 may detect that the garment is present on the loading plate 210 and transfer information on the presence of the garment to a control unit 500. The control unit 500 may determine that the garment has inputted into the garment folding machine 1, and the control unit 500 may operate the loading conveyor motor ML. Therefore, the loading conveyor 230 may rotate to transfer the garment into the housing 100 of the garment folding machine 1.

Meanwhile, the loading plate 210 may be further equipped with the roller 240. The roller 240 may be rotatably coupled to the loading plate 210. The roller 240 may be disposed vertically below the loading conveyor 230. In case that the garment is placed on the loading plate 210, the roller 240 may come into contact with a lower surface of the garment.

With this configuration, when the garment moves toward the rear side of the loading plate 210 along the loading plate 210, the roller may autonomously rotate while coming into contact with the lower surface of the garment and reduce the occurrence of friction between the garment and the loading plate 210. Moreover, in case that the garment is transferred in a state in which the garment is pressed in an upward/downward direction by the loading conveyor 230, the roller 240 may assist in smoothly transferring the garment while being rotated by the movement of the garment and prevent damage to the garment during the transfer process.

Meanwhile, the garment length calculation sensor SL2 may be disposed on the loading plate 210. The garment length calculation sensor SL2 may calculate a length of the garment by detecting that a rear end of the garment passes over the garment length calculation sensor SL2. For example, the garment length calculation sensor SL2 may serve to detect whether the garment C is present in the effective detection range. The garment length calculation sensor SL2 is a digital sensor that outputs an ON-signal when the garment C passes over the garment length calculation sensor SL2, and outputs an OFF-signal after the rear end of the garment C passes over the garment length calculation sensor SL2. In the embodiment according to the present disclosure, a contactless IR (infrared ray) sensor may be applied, for example, but the present disclosure is not limited thereto.

A process of calculating the length of the garment will be described below.

The folding unit 300 serves to transfer and fold the garment loaded by the loading unit 200.

The folding unit 300 is disposed in the housing 100 and includes the lateral plates 310, a first conveyor 320, a second conveyor 330, the horizontal frames 340, a third conveyor 350, first folding plates 360, and a second folding plate 370.

Specifically, the folding unit 300 may transfer and fold the garment by rotating (circulating) the first conveyor 320, the second conveyor 330, and the third conveyor 350 and fold the garment by rotating the first folding plates 360 and the second folding plate 370.

The first conveyor 320 and the second conveyor 330 may be coupled to the lateral plates 310. For example, the lateral plate 310 may be formed in a flat plate shape. The pair of lateral plates 310 may be disposed to face each other. The loading plate 210, the guide plates 220, the loading conveyor 230, the first conveyor 320, and the second conveyor 330 may be coupled between the pair of lateral plates 310. In this case, the loading conveyor 230 may be coupled to the lateral plates 310 so as to be movable in the upward/downward direction, and the first conveyor 320 and the second conveyor 330 may be coupled to the lateral plates 310 so as to be rotatable.

For example, first guide holes 311 and second guide holes 312 may be formed in the lateral plates 310, and guide rails 313 may be provided on the lateral plates 310. The first guide hole 311 and the second guide hole 312 may guide the rotation of the first conveyor 320. That is, protrusions may protrude from two opposite surfaces of the first conveyor 320, and fixing screws 323 may be provided at predetermined intervals from the protrusions. In this case, the protrusions of the first conveyor 320 may be accommodated in the first guide holes 311, and the fixing screws 323 may penetrate the second guide holes 312. In this case, the first guide hole 311 and the second guide hole 312 may be formed in arc shapes having the same origin and different radii. In this case, the origin may be a position of a rotation axis about which the first conveyor 320 rotates. Therefore, when the first conveyor 320 rotates, the protrusions of the first conveyor 320 may rotate along the first guide holes 311, and the fixing screws 323 may rotate along the second guide holes 312. Meanwhile, the guide rails 313 may be respectively provided on inner surfaces of the pair of lateral plates 310 that face each other. In this case, the guide rail 313 may be disposed in the gravitational direction. The guide rails 313 may be coupled to rail accommodation portions formed on two opposite surfaces of the loading conveyor 230. With this configuration, the loading conveyor 230 may rectilinearly move in the upward/downward direction along the guide rails 313.

Meanwhile, the lateral plates 310 may be provided in the housing 100 and configured to be rectilinearly movable in a forward/rearward direction. For example, the lateral plates 310 may be rectilinearly movably coupled to the horizontal frames 340. With this configuration, in case that the garment folding machine 1 is used, the lateral plates 310 may move toward the front side of the housing 100, such that the loading unit 200 may be exposed to the outside of the housing 100. In case that the garment folding machine 1 is not used, the lateral plates 310 may move toward the rear side of the housing 100, such that an overall volume may be reduced.

The first conveyor 320 may serve to transfer the garment, which has passed through the loading unit 200, from the upper side toward the lower side in the gravitational direction. The first conveyor 320 may be connected to a first conveyor motor MC1 and receive driving power provided by the first conveyor motor MC1.

For example, the first conveyor 320 may include conveyor shafts 321 and a belt 322, and the conveyor shafts 321 may be connected to the first conveyor motor MC1 through gears. In this case, when the first conveyor motor MC1 operates, the conveyor shafts 321 may rotate by receiving driving power from the first conveyor motor MC1, and the belt 322 of the first conveyor 320 may transfer the garment while being circulated by the rotations of the conveyor shafts 321.

Meanwhile, the first conveyor 320 may be disposed below and rearward of a rear end of the loading plate 210. The first conveyor 320 may be provided to be inclined at a predetermined angle with respect to a ground surface. For example, the first conveyor 320 may be disposed to inclined rearward and downward from a front end thereof.

The first conveyor 320 may rotate so that an upper surface of the belt 322 moves from the front side toward the rear side, and a lower surface of the belt 322 moves from the rear side toward the front side. Further, the garment may be placed on the upper surface of the belt 322 of the first conveyor 320 and transferred.

With this configuration, when the first conveyor motor MC1 operates, the first conveyor 320 may transfer the garment, which has passed over the loading plate 210, rearward and downward.

Meanwhile, the operation of the first conveyor motor MC1 may be initiated when the garment input detection sensor SL1 detects the garment. For example, when the garment input detection sensor SL1 begins to detect the presence of the garment, the garment input detection sensor SL1 transmits a signal, which indicates the presence of the garment, to the control unit 500. The control unit 500, which receives the signal, may determine that the garment is inputted to the garment folding machine 1, and the control unit 500 may operate the first conveyor motor MC1. Therefore, the first conveyor 320 may transfer the garment rearward and downward while rotating.

Meanwhile, a first conveyor sensor SC1 may be disposed at a predetermined position on the first conveyor 320. The first conveyor sensor SC1 may detect that the garment is placed on the first conveyor 320 and passes over the predetermined position. For example, the first conveyor sensor SC1 serves to detect whether the garment C is present in the effective detection range. The first conveyor sensor SC1 is a digital sensor that outputs an ON-signal when the garment C is present in the effective detection range, and outputs an OFF-signal when the garment C is not present in the effective detection range. In the embodiment according to the present disclosure, a contactless IR (infrared ray) sensor may be applied, for example, but the present disclosure is not limited thereto.

With this configuration, when the garment is transferred by the first conveyor 320, the first conveyor sensor SC1 may detect that the garment is present at the predetermined position on the first conveyor 320, and the first conveyor sensor SC1 may transfer information on the presence of the garment to the control unit 500. The control unit 500 may determine that the garment has passed over the predetermined position, and the control unit 500 may operate a second conveyor motor MC2. In this case, the control unit 500 may, of course, operate the second conveyor motor MC2 immediately after receiving the information from the first conveyor sensor SC1. Alternatively, the control unit 500 may operate the second conveyor motor MC2 when a predetermined time elapses after receiving the information from the first conveyor sensor SC1. With this configuration, the garment having passed over the first conveyor 320 may be transferred by the second conveyor 330.

The second conveyor 330 may serve to transfer the garment having passed over the first conveyor 320. The second conveyor 330 may be connected to the second conveyor motor MC2 and receive driving power provided by the second conveyor motor MC2.

For example, the second conveyor 330 may include conveyor shafts 331 and a belt 332, and the conveyor shaft 331 may be connected to the second conveyor motor MC2 through gears. In this case, when the second conveyor motor MC2 operates, the conveyor shafts 331 may rotate by receiving driving power from the second conveyor motor MC2, and the belt 332 of the second conveyor 330 may transfer the garment while being circulated by the rotations of the conveyor shafts 331.

Meanwhile, the second conveyor 330 may be disposed below the first conveyor 320. The second conveyor 330 may be provided to be inclined at a predetermined angle with respect to the ground surface, and an angle of the second conveyor 330 may be changed by the rotation of the second conveyor 330. Specifically, the second conveyor 330 may rotate about a rotation axis, i.e., the conveyor shaft 331 disposed at the front side between the pair of conveyor shafts 331. A rear end of the second conveyor 330 may rotate while defining an arc. Therefore, a height of the rear end of the second conveyor 330 may be changed.

For example, the second conveyor 330 may include a rotation driving gear 333 and a rotation driven gear 334. The rotation driving gear 333 is connected to a shaft of a second conveyor movement motor MR to be described below. The rotation driving gear 333 rotates when the second conveyor movement motor MR operates. The rotation driven gear 334 engages with the rotation driving gear 333 and be coupled to the conveyor shaft 331. The rotation driven gear 334 may be rotated in conjunction with the rotation of the rotation driving gear 333 when the rotation driving gear 333 rotates.

The second conveyor 330 may be provided to be changed in rotation direction (circulation direction). That is, a direction in which the second conveyor 330 transfers the garment may be changed by a change in rotation direction of the second conveyor motor MC2.

When the second conveyor motor MC2 rotates in one direction (hereinafter, referred to as a 'forward direction'), the second conveyor 330 may rotate so that an upper surface of the belt 332 moves from the rear side toward the front side, and a lower surface of the belt 332 moves from the front side toward the rear side. Further, the garment may be placed on the upper surface of the belt 332 and transferred. With this configuration, the second conveyor 330 may transfer the garment, which has passed over the first conveyor 320, forward.

On the contrary, when the second conveyor motor MC2 rotates in a direction (hereinafter, referred to as a 'reverse direction') opposite to one direction, the second conveyor 330 may rotate so that the upper surface of the belt 332 moves from the front side toward the rear side, and the lower surface of the belt 332 moves from the rear side toward the front side. Further, the garment may be placed on the upper surface of the belt 332 and transferred. With this configuration, the second conveyor 330 may transfer the garment rearward.

Meanwhile, the operation of the second conveyor motor MC2 may be initiated when the first conveyor sensor SC1 detects the garment. For example, when the first conveyor sensor SC1 begins to detect the presence of the garment, the first conveyor sensor SC1 transmits a signal, which indicates the presence of the garment, to the control unit 500. The control unit 500, which receives the signal, may determine that the garment is transferred toward the second conveyor 330, and the control unit 500 may operate the second conveyor motor MC2. Therefore, the second conveyor 330 may rotate to transfer the garment that is transferred while passing over the first conveyor 320. In this case, the second conveyor motor MC2 may rotate in the forward direction and transfer the garment, which has passed over the first conveyor 320, toward the front side of the garment folding machine 1.

Meanwhile, a speed at which the second conveyor 330 transfers the garment may be equal to or higher than a speed at which the first conveyor 320 transfers the garment. With this configuration, it is possible to prevent the garment from being wrinkled during the process of transferring the garment.

Meanwhile, a second conveyor sensor SC2 may be disposed at a predetermined position (hereinafter, referred to as a 'direction change position') on the second conveyor 330. The second conveyor sensor SC2 may detect that the garment is placed on the second conveyor 330 and passes over the predetermined position.

With this configuration, when the garment is transferred by the second conveyor 320, the second conveyor sensor SC2 may detect that the garment is present at the predetermined position on the second conveyor 330, and the second conveyor sensor SC2 may transfer information on the presence of the garment to the control unit 500. The control unit 500 may determine that the garment has passed over the predetermined position, and the control unit 500 may change the rotation direction of the second conveyor motor MC2. In this case, the control unit 500 may, of course, change the rotation direction of the second conveyor motor MC2 immediately after receiving the information from the second conveyor sensor SC2. Alternatively, the control unit 500 may change the rotation direction of the second conveyor motor MC2 when a predetermined time elapses after receiving the information from the second conveyor sensor SC2. With this configuration, the garment, which has been transferred forward by the second conveyor 330, may be transferred toward the rear side of the garment folding machine 1.

The horizontal frames 340 may serve to divide the space in the housing 100 into upper and lower spaces and guide the forward/rearward movement of the lateral plate 310. The first folding plate 360 and the second folding plate 370, which will be described below, may be rotatably coupled to the horizontal frames 340. In addition, the third conveyor 350 may be rotatably coupled to the horizontal frames 340.

For example, the horizontal frames 340 may include a pair of forward/rearward frames disposed side by side at a predetermined interval, and a leftward/rightward frame disposed perpendicularly to the forward/rearward frames. That is, an overall shape of the horizontal frame 340 may be similar to a 'L' shape. In this case, the pair of first folding plates 360 may be respectively coupled to the pair of forward/rearward frames, and the second folding plate 370 may be coupled to the leftward/rightward frame. In addition, the third conveyor 350 may be disposed between the pair of forward/rearward frames.

The garment may be folded in the upper space based on the horizontal frames 340, and the garment may be unloaded in the lower space based on the horizontal frames 340. That is, the garment at the upper sides of the horizontal frames 340 may be folded while passing over the first conveyor 330 and the second conveyor 330, and at least a part of the garment having passed over the second conveyor 330 may be placed on the horizontal frames 340. The garment may be folded by the rotations of the first folding plates 360 and the second folding plate 370 at the same height as the horizontal frames 340. Further, the garment, which is folded at the upper sides of the horizontal frames 340, may be transferred downward by the third conveyor 350 and unloaded.

The third conveyor 350 may serve to transfer the garment having passed over the first conveyor 320 and/or the second conveyor 330. The third conveyor 350 may be connected to a third conveyor motor MC3 and receive driving power provided by the third conveyor motor MC3.

For example, the third conveyor 350 may include conveyor shafts 351 and a belt 352, and the conveyor shafts 351 may be connected to the third conveyor motor MC3 through gears. In this case, when the third conveyor motor MC3 operates, the conveyor shafts 351 may rotate by receiving driving power from the third conveyor motor MC3, and the belt 352 of the third conveyor 350 may transfer the garment while being circulated by the rotations of the conveyor shafts 351.

Meanwhile, the third conveyor 350 may be disposed rearward of the second conveyor 330. The third conveyor 350 may be disposed in parallel with the ground surface and provided to be rotatable. Specifically, the third conveyor 350 may rotate about a rotation axis, i.e., the conveyor shaft disposed at the rear side between the pair of conveyor shafts. A front end of the third conveyor 350 may rotate while defining an arc. Therefore, a height of the front end of the third conveyor 350 may be changed.

The third conveyor 350 may be connected to a third conveyor movement motor MU. The third conveyor 350 may guide the garment to the unloading unit 400 while rotating by receiving driving power from the third conveyor movement motor MU.

For example, when the third conveyor movement motor MU operates after the garment is folded in the state in which the third conveyor 350 is disposed in parallel with the ground surface, the front end of the third conveyor 350 may rotate downward. Therefore, a movement of the completely folded garment may be guided toward the lower sides of the horizontal frames 340 by gravity.

The third conveyor 350 may be provided to be changed in rotation direction (circulation direction). That is, a direction in which the third conveyor 350 transfers the garment may be changed by a change in rotation direction of the third conveyor motor MC3.

When the third conveyor motor MC3 rotates in one direction (hereinafter, referred to as a 'forward direction'), the third conveyor 350 may rotate so that an upper surface of the belt moves from the front side toward the rear side, and a lower surface of the belt moves from the rear side toward the front side. Further, the garment may be placed on the upper surface of the belt and transferred. With this configuration, the third conveyor 350 may transfer the garment, which has passed over the second conveyor 330, rearward and transfer the garment in accordance with a horizontal folding position calculated by the control unit 500.

In addition, when the third conveyor motor MC3 rotates in a direction (hereinafter, referred to as a 'reverse direction') opposite to one direction, the third conveyor 350 may rotate so that the upper surface of the belt moves from the rear side toward the front side, and the lower surface of the belt moves from the front side toward the rear side. Further, the garment may be placed on the upper surface of the belt and transferred. With this configuration, the second conveyor 330 may transfer the garment forward. In the state in which the third conveyor 350 is rotated downward, the completely folded garment may be transferred to the unloading unit 400.

The first folding plates 360 may be rotatably coupled to the horizontal frames 340 and fold the garment while rotating. For example, the pair of first folding plates 360 may be provided to be linearly symmetric and vertically fold the garment while rotating.

In this case, the vertical folding means that the garment is folded about a reference line parallel to the proceeding direction of the garment. The direction parallel to the proceeding direction of the garment is not limited to a configuration in which the line in the proceeding direction of the garment and the folding line are perfectly disposed at 0 degree, but the direction parallel to the proceeding direction of the garment includes a configuration in which the line in the proceeding direction of the garment and the folding line are disposed within an error range of 0 degree to 30 degrees.

The first folding plates 360 may be disposed above the horizontal frames 340. Specifically, rotary shafts of the first folding plates 360 may be respectively provided at inner ends of the pair of horizontal frames 340 and disposed in the forward/rearward direction of the garment folding machine 1.

The rotary shafts of the first folding plates 360 may be connected to a first folding plate drive motor MP1 and receive rotational power. Therefore, when the first folding plate drive motor MP1 operates, the first folding plates 360 may rotate toward the inside of the horizontal frames 340 (i.e., toward the third conveyor 350).

When the garment passes over the second conveyor 330 and reaches the upper portion of the third conveyor 350, at least a part of the garment may be placed on the pair of first folding plates 360. In this case, when the first folding plates 360 rotate, a part of an outer portion of the garment based on the leftward/rightward direction, which includes the sleeve, may be folded toward the inside of the garment, such that the garment may be vertically folded.

The second folding plate 370 may be rotatably coupled to the horizontal frames 340 and fold the garment while rotating. For example, the second folding plate 370 may horizontally fold the garment while rotating.

In this case, the horizontal folding means that the garment is folded about a reference line perpendicular to the proceeding direction (loading direction) of the garment. The direction perpendicular to the proceeding direction of the garment is not limited to a configuration in which a line in the proceeding direction of the garment and a folding line are perfectly disposed at 90 degrees, but the direction perpendicular to the proceeding direction of the garment includes a configuration in which the line in the proceeding direction of the garment and the folding line are disposed within an error range of 0 degree to 30 degrees.

The second folding plate 370 may be disposed above the horizontal frames 340. Specifically, a rotary shaft of the second folding plate 370 may be provided at the inner ends of the horizontal frames 340 and disposed in the leftward/rightward direction of the garment folding machine 1.

The rotary shaft of the second folding plate 370 may be connected to a second folding plate drive motor MP2 and receive rotational power. Therefore, when the second folding plate drive motor MP2 operates, the second folding plate 370 may rotate toward the inside of the horizontal frames 340 (i.e., toward the third conveyor 350).

When the garment is transferred rearward by the third conveyor 350, a tip of the garment may be placed on the second folding plate 370. In this case, when the second folding plate 370 rotates, a part of the garment, which includes the tip, may be folded toward the inside of the garment, such that the garment may be horizontally folded.

Figure 8:
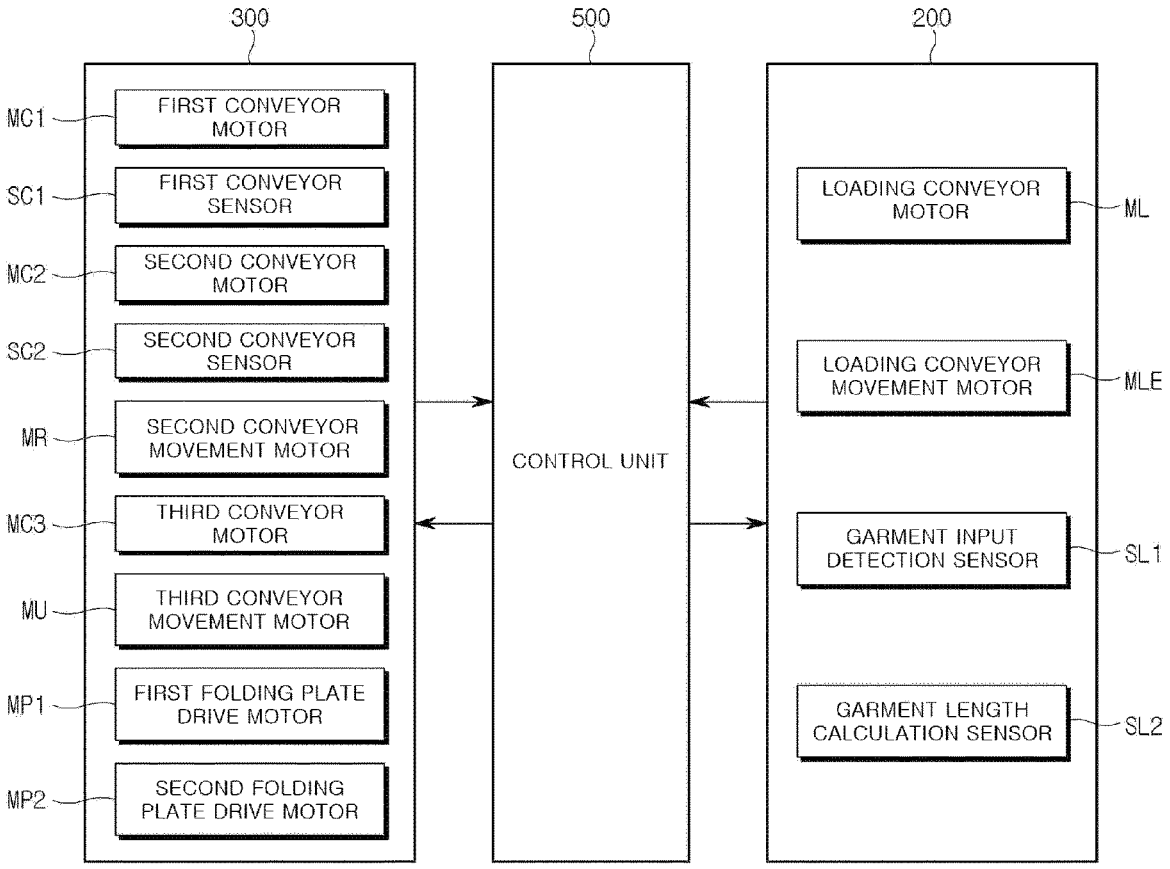
FIG. 8 is a block diagram for explaining a configuration for controlling the garment folding machine according to the present disclosure.

Meanwhile, FIG. 8 is a block diagram for explaining a configuration for controlling the garment folding machine according to the embodiment of the present disclosure.

The configuration for controlling the garment folding machine according to the embodiment of the present disclosure will be described with reference to FIG. 8.

The control unit 500 may control the loading unit 200, the folding unit 300, and the unloading unit 400.

The control unit 500 is provided to control an operation of the garment folding machine 1 based on the user's instruction applied through an input unit (not illustrated). The control unit 500 may include a printed circuit board and elements mounted on the printed circuit board. When the user selects types of garments or folding courses through the input unit and then inputs a control instruction for the operation, the control unit 500 may control the operation of the garment folding machine 1 based on a preset algorithm.

Meanwhile, the control unit 500 may be electrically connected to the input unit (not illustrated) to receive a user's control instruction, and electrically connected to a display unit (not illustrated) and an alarm unit (not illustrated) to provide the display unit (not illustrated) and the alarm unit (not illustrated) with the information on the operating state of the garment folding machine 1, thereby transmitting the corresponding information to the user.

In addition, the control unit 500 controls a power conversion part and a current detection part. The power conversion part converts power, which is inputted from an external power source, and supplies the power to the loading unit 200, the folding unit 300, and the unloading unit 400. The current detection part detects the electric current supplied from the power conversion part to the loading unit 200, the folding unit 300, and the unloading unit 400.

In addition, the control unit 500 may further include a memory configured to store information inputted in advance or inputted through the input unit (not illustrated), and a timer capable of measuring the time.

Meanwhile, the control unit 500 may be electrically connected to the loading unit 200, the folding unit 300, and the unloading unit 400 so as to transmit or receive signals therebetween.

For example, the control unit 500 may transmit drive control signals to the loading unit conveyor motor ML and the loading conveyor movement motor MLE of the loading unit 200. In addition, the control unit 500 may receive signals, which indicate whether the garment is present at the predetermined position on the loading plate 210, from the garment input detection sensor SL1 and the garment length calculation sensor SL2 of the loading unit 200.

In addition, the control unit 500 may transmit drive control signals to the plurality of motors MC1, MC2, MC3, MR, MU, MP1, and MP2 of the folding unit 300. In addition, although not illustrated, the control unit 500 may receive signals, which indicate whether the first conveyor 320, the second conveyor 330, the third conveyor 350, the first folding plate 360, and the second folding plate 370 operate at accurate positions, from the sensors provided in the folding unit 300. In addition, the control unit 500 may receive signals, which indicate whether the garment passes over the predetermined position, from the first conveyor sensor SC1 and the second conveyor sensor SC2.

In addition, although not illustrated, the control unit 500 may receive signals, which indicate whether the garment is unloaded, from the sensors provided in the unloading unit 400.

With this configuration, the control unit 500 may determine whether the garment C passes, and the control unit 500 may perform the vertical folding or the horizontal folding on the garment C.

A specific control operation of the control unit 500 according to the present disclosure will be described below.

Figure 9:
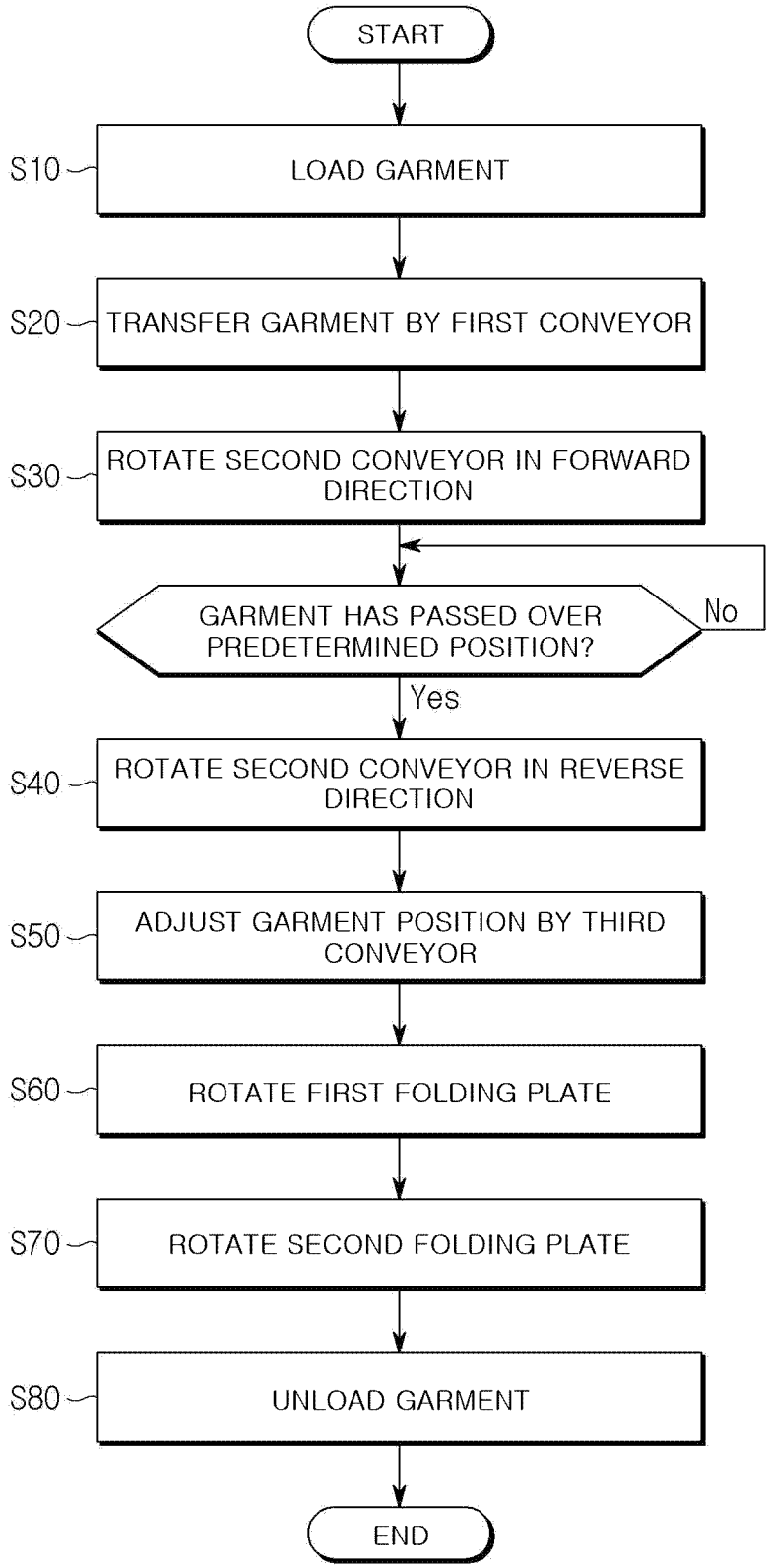
FIG. 9 is a flowchart for explaining a method of controlling the garment folding machine according to the present disclosure.

Meanwhile, FIG. 9 is a flowchart for explaining a method of controlling the garment folding machine according to the present disclosure, and FIGS. 10 to 19 are views for explaining a process of folding the garment by applying the method of controlling the garment folding machine according to the present disclosure.

The process of folding the garment by the garment folding machine according to the present disclosure will be described below with reference to FIGS. 9 to 19.

The method of controlling the garment folding machine according to the present disclosure may include a loading step S10 of loading the garment C into the housing 100.

Figure 10:
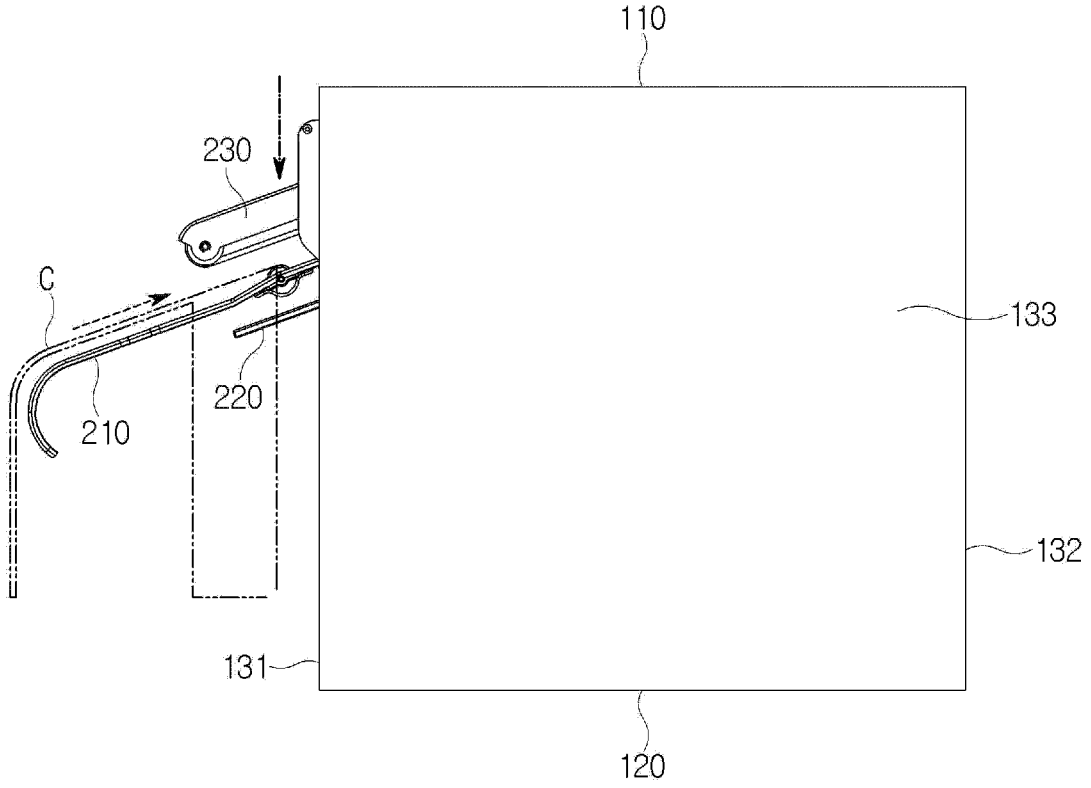
FIGS. 10 to 19 are views for explaining a process of folding a garment by applying the method of controlling the garment folding machine according to the present disclosure.

With reference to FIG. 10, in the loading step S10, the garment may be loaded onto the loading plate 210 by a user and inserted into the housing 100. In this case, when the tip of the garment C moves to a position at which the garment input detection sensor SL1 is disposed, the garment input detection sensor SL1 may detect the presence of the garment C and transfer information to the control unit 500. Further, when the control unit 500 receives the information from the garment input detection sensor SL1, the control unit 500 may determine that the garment C is inputted to the garment folding machine 1, and the control unit 500 may operate the loading conveyor movement motor MLE and the loading conveyor motor ML. Therefore, the loading conveyor 230 may push the upper surface of the garment with predetermined pressure while being moved downward by the operation of the loading conveyor movement motor MLE, and the loading conveyor 230 may transfer the garment C into the housing 100 of the garment folding machine 1 while rotating (circulating).

Meanwhile, the control unit 500 may use the embedded timer (not illustrated) and measure the time from the moment when the garment input detection sensor SL1 begins to detect the presence of the garment C.

Meanwhile, in the loading step S10, the sleeve may be primarily folded at the same time when the garment C is transferred into the housing 100 by the operation of the loading plate 210 and the operation of the guide plate 220.

That is, in the loading step S10, the sleeve of the garment sags downward from the loading plate 210, and the garment moves rearward along the loading plate 210, such that the sleeve of the garment comes into contact with the guide plate 220 and is folded toward the inside of the garment. Therefore, in a state in which the sleeve portion of the upper garment is folded by a predetermined amount, the garment may be pulled by the loading conveyor 230, the vertical folding (sleeve folding) may be primarily and manually performed on the garment, and the garment may be loaded onto the first conveyor 320.

Therefore, according to the present disclosure, the folding process may be simplified, and the apparatus may be miniaturized.

Meanwhile, when the garment input detection sensor SL1 detects that the tip of the garment C has passed through the loading unit 200, the control unit 500 performs a first conveyor transfer step S20. The first conveyor transfer step S20 may be performed simultaneously with the loading step S10. Alternatively, the first conveyor transfer step S20 may start when a predetermined time elapses after the loading step S10 starts.

In the first conveyor transfer step S20, the garment C, which has passed through the loading unit 200, may be transferred from the front upper side toward the rear lower side of the garment folding machine 1.

Figure 11:
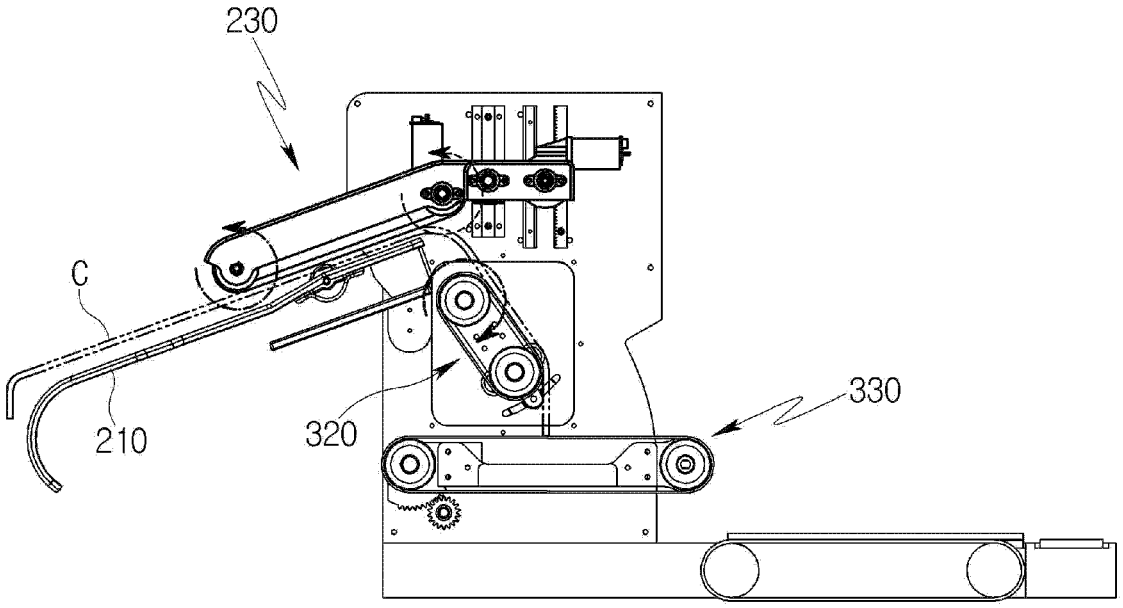
Figure 12:
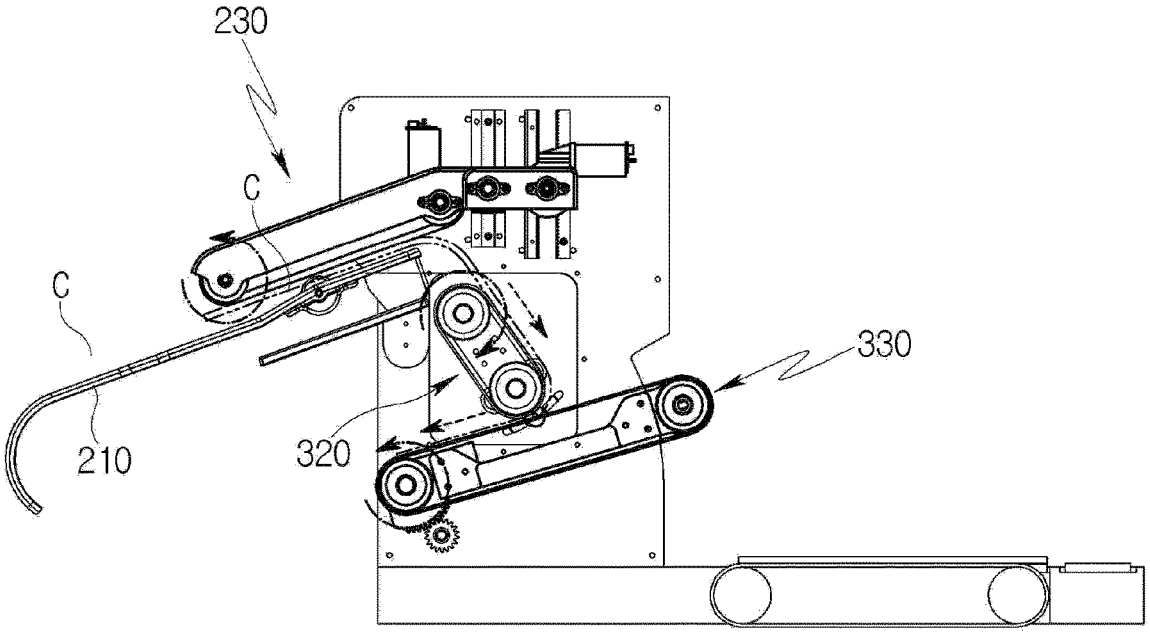
Figure 13:
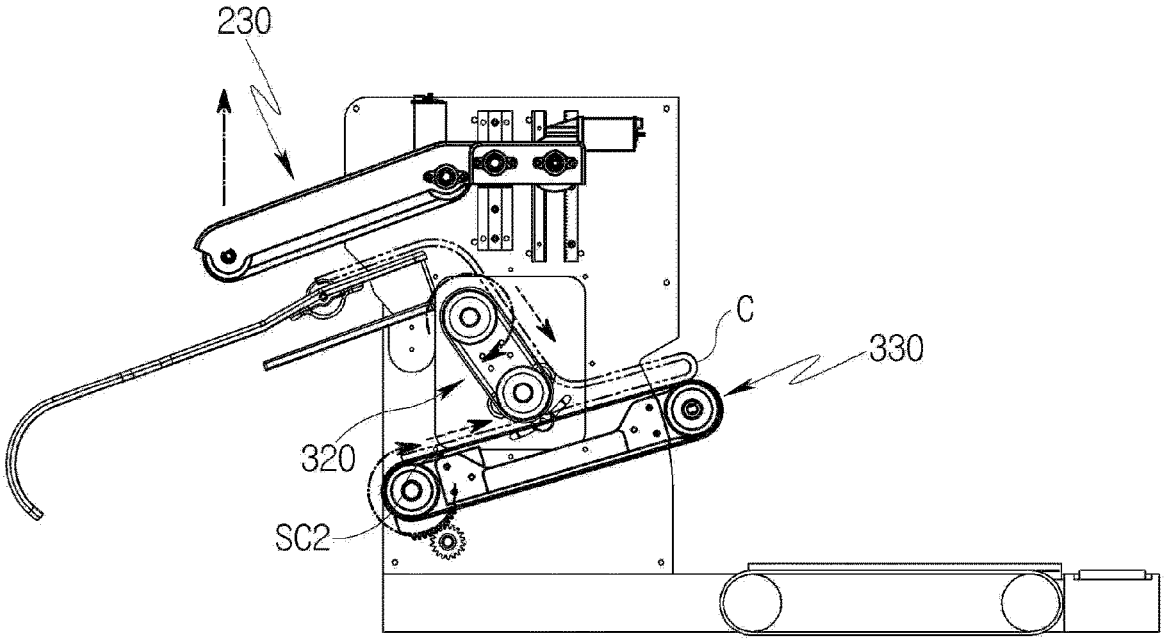
Figure 14:
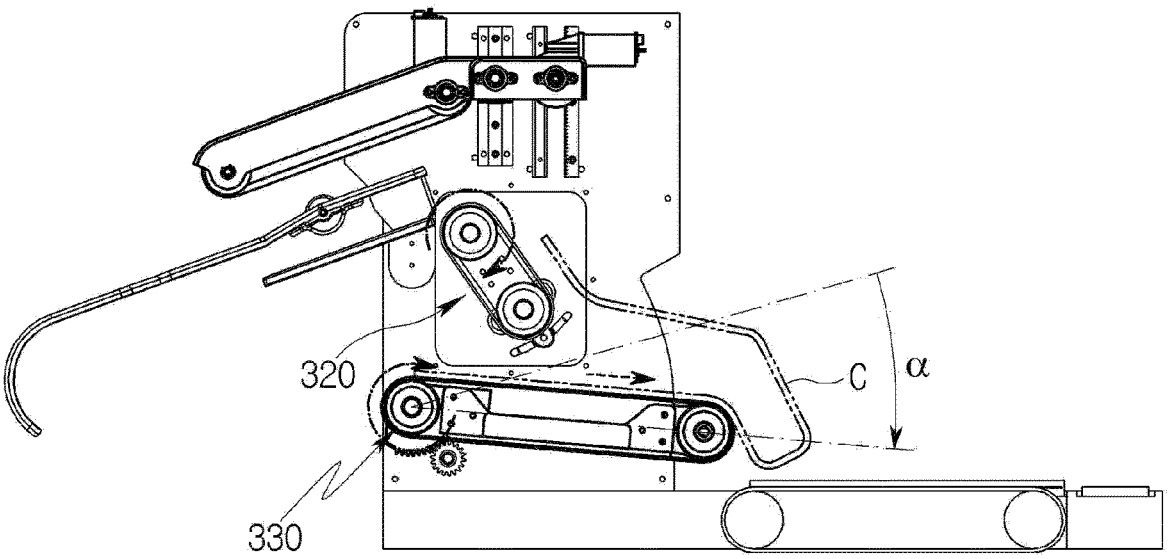
Figure 15:
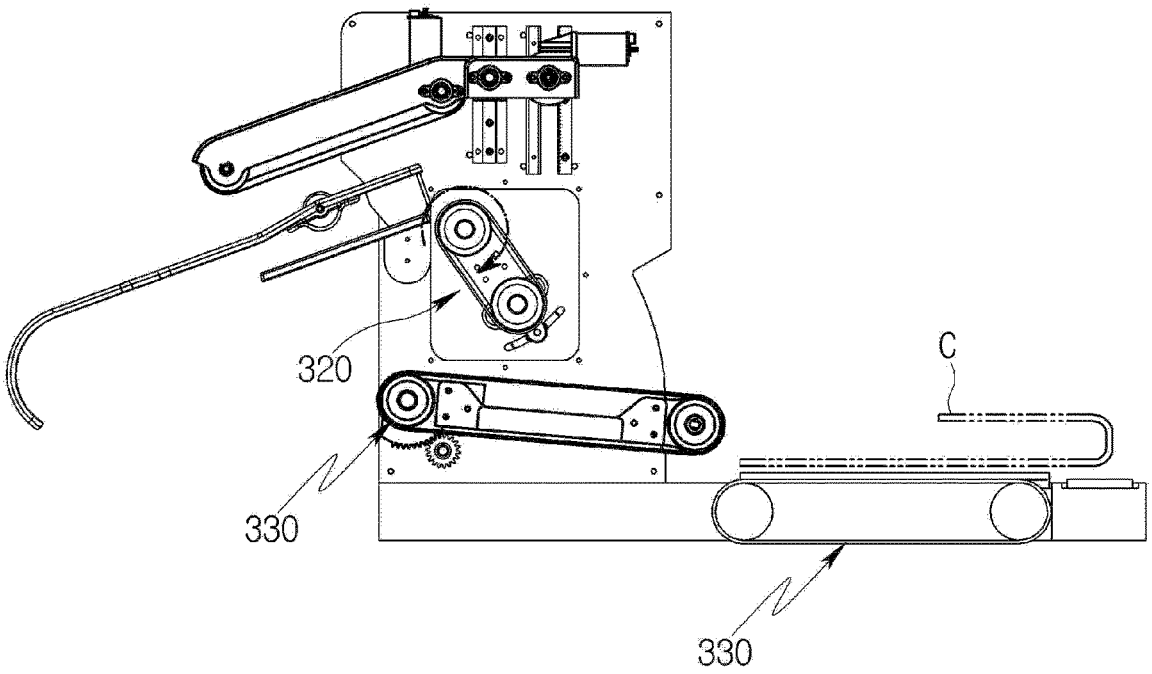
Figure 16:
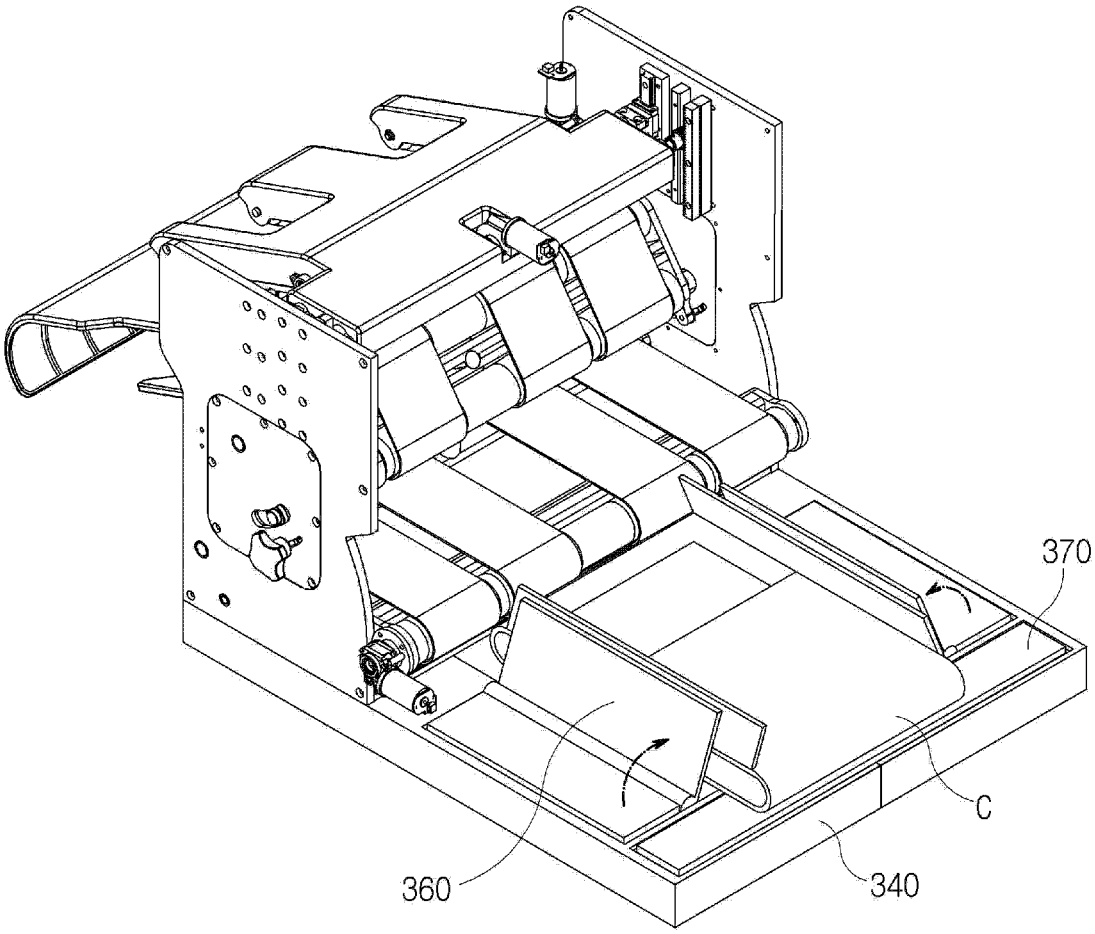
Figure 17:
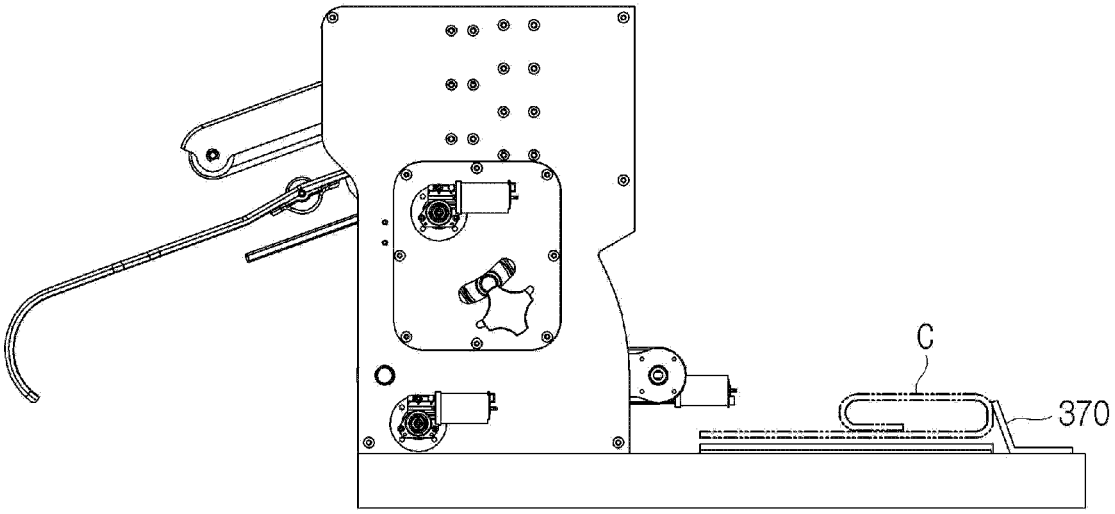
Figure 18:
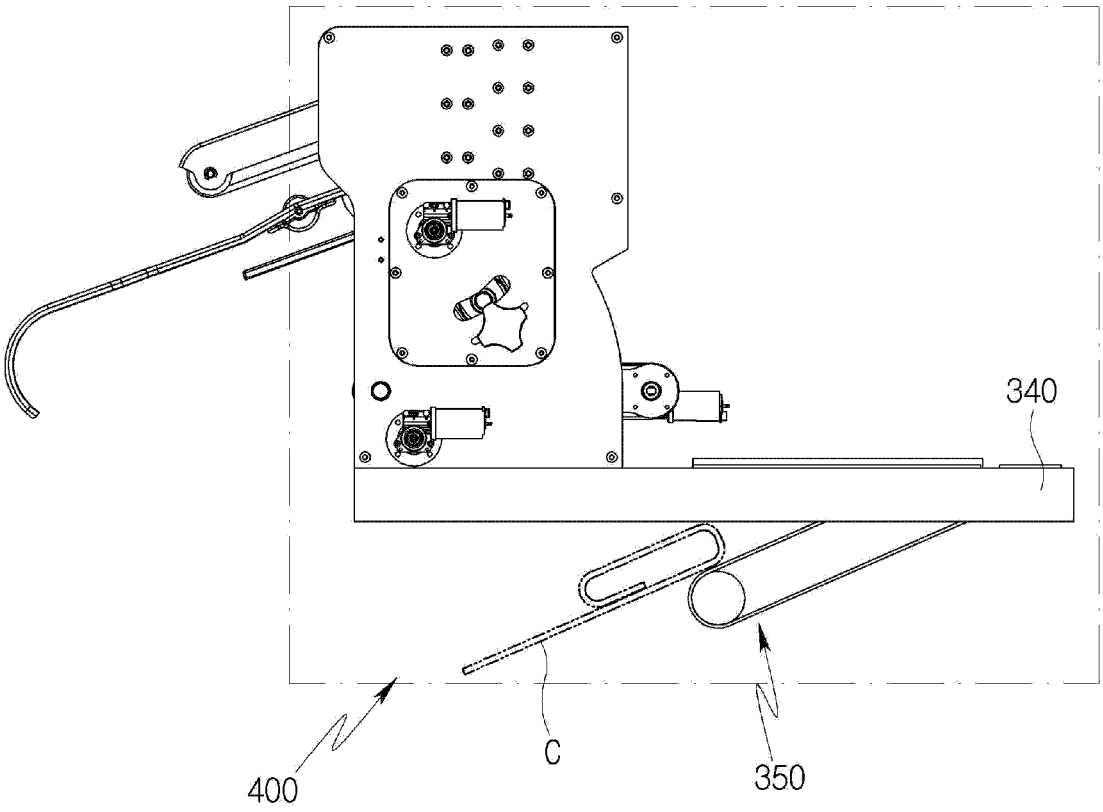
Figure 19:
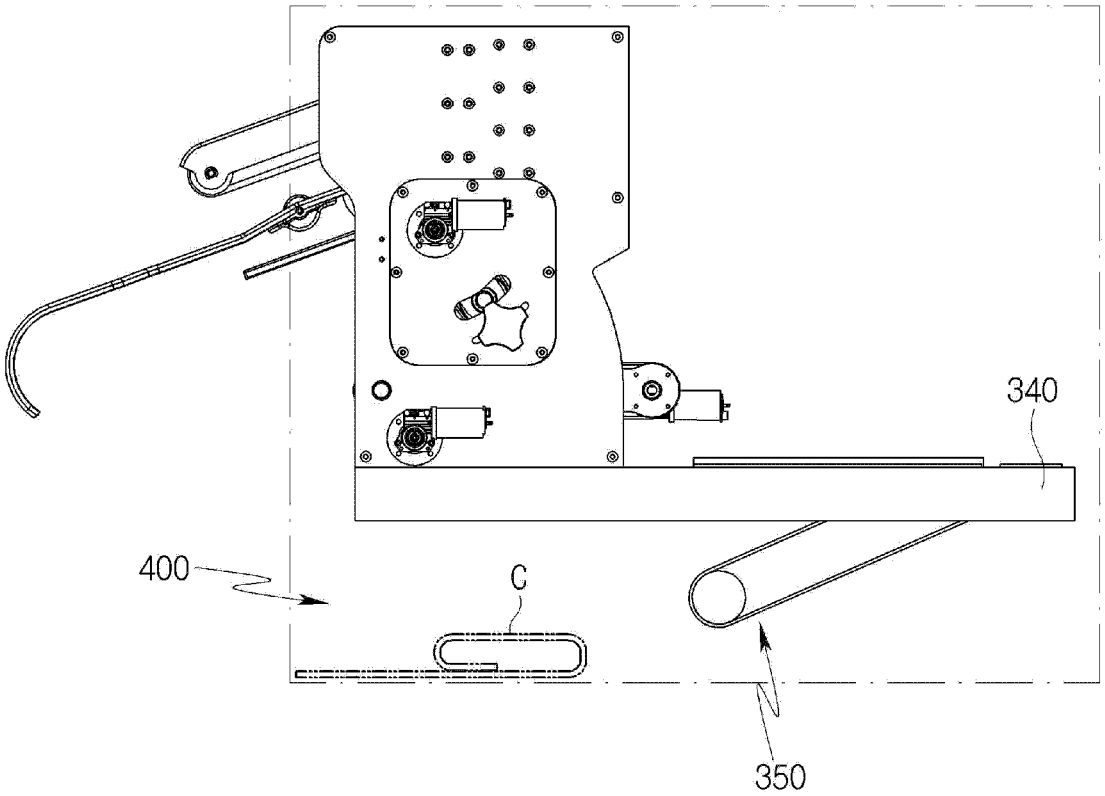

In the first conveyor transfer step S20, when the garment input detection sensor SL1 begins to detect the presence of the garment, the control unit 500 operates the first conveyor motor MC1 and transfers the garment C (see FIG. 11).

Specifically, in the first conveyor transfer step S20, the control unit 500 may receive information, which indicates that the garment has passed over the predetermined position on the loading plate 210, from the garment input detection sensor SL1 and determine that the garment C has been inputted to the garment folding machine 1, and the control unit 500 may operate the first conveyor motor MC1. Therefore, the first conveyor 320 may transfer the garment rearward and downward while rotating. In this case, the control unit 500 may, of course, operate the first conveyor motor MC1 while simultaneously receiving the information, which indicates that the garment is inputted, from the garment input detection sensor SL1. Alternatively, the control unit 500 may operate the first conveyor motor MC1 when a predetermined time elapses after receiving the information, which indicates that the garment is inputted, from the garment input detection sensor SL1.

Meanwhile, in the first conveyor transfer step S20, the control unit 500 may perform control so that a rotational speed of the first conveyor motor MC1 is higher than a rotational speed of the loading conveyor motor ML1. That is, in the first conveyor transfer step S20, a speed at which the first conveyor 320 transfers the garment C may be higher than a speed at which the loading conveyor 230 transfers the garment C. With this configuration, in the first conveyor transfer step S20, the transferred garment C may be pulled by a difference in transfer speed between the first conveyor 320 and the loading conveyor 230, which may prevent the garment from being wrinkled.

Meanwhile, in the first conveyor transfer step S20, when the garment is transferred by the first conveyor 320, the first conveyor sensor SC1 may detect that the garment C is present at the predetermined position on the first conveyor 320, and the first conveyor sensor SC1 may transfer information on the presence of the garment to the control unit 500. The control unit 500 may determine that the garment has passed over the predetermined position, and the control unit 500 may perform a second conveyor transfer step S30.

The second conveyor transfer step S30 may be performed together with the first conveyor transfer step S20 in a state in which the first conveyor transfer step S20 is performed. The second conveyor transfer step S30 may be performed together with the loading step S10 and the first conveyor transfer step S20 in accordance with a length of the garment C in a state in which the loading step S10 and the first conveyor transfer step S20 are performed.

In the second conveyor transfer step S30, when the first conveyor sensor SC1 begins to detect the presence of the garment, the control unit 500 operates the second conveyor motor MC2 and transfers the garment C.

Specifically, in the second conveyor transfer step S30, the control unit 500 may receive information, which indicates that the garment has passed over the predetermined position on the first conveyor 320, from the first conveyor sensor SC1, and then the control unit 500 may operate the second conveyor motor MC2. In this case, the control unit 500 may, of course, operate the second conveyor motor MC2 while simultaneously receiving the information, which indicates that the garment is inputted, from the first conveyor sensor SC1. Alternatively, the control unit 500 may operate the second conveyor motor MC2 when a predetermined time elapses after receiving the information, which indicates that the garment is inputted, from the first conveyor sensor SC1. With this configuration, the garment having passed over the first conveyor 320 may be transferred forward by the second conveyor 330 (see FIG. 12).

Further, in the second conveyor transfer step S30, when the first conveyor sensor SC1 begins to detect the presence of the garment, the control unit 500 may operate the second conveyor movement motor MR and form a folding gap between the first conveyor 320 and the second conveyor 330.

Specifically, in the second conveyor transfer step S30, when the control unit 500 may receive information, which indicates that the garment C has passed over the predetermined position on the first conveyor 320, from the first conveyor sensor SC1, the control unit 500 may operate the second conveyor movement motor MR and rotate the second conveyor 320. In this case, the second conveyor movement motor MR may change a shortest distance between the first conveyor 320 and the second conveyor 330 while changing the rotation direction. For example, the control unit 500 may control the second conveyor movement motor MR so that a value of an electric current for the motor to be supplied to the second conveyor motor MC2 is maintained within a predetermined motor electric current value range. In this case, a distance (interval) of the folding gap may be smaller than a thickness of the garment C. With this configuration, the garment C may pass through the folding gap between the first conveyor 320 and the second conveyor 330, and the garment C may be stretched to have a predetermined thickness by being pressed between the first conveyor 320 and the second conveyor 330.

Meanwhile, the control unit 500 may perform lower edge folding on the garment (S40, hereinafter, referred to as a 'lower edge folding step') by performing control to rotate the second conveyor motor MC2 in the forward direction and then performing control to change the rotation direction of the second conveyor motor MC2 and rotate the second conveyor motor MC2 in the reverse direction.

Specifically, when the control unit 500 receives information, which indicates that the garment C has passed over the predetermined position on the second conveyor 330, from the second conveyor sensor SC2, the control unit 500 may change the rotation direction of the second conveyor motor MC2 to the reverse direction. In this case, the control unit 500 may, of course, change the rotation direction of the second conveyor motor MC2 immediately after receiving the information from the second conveyor sensor SC2. Alternatively, the control unit 500 may change the rotation direction of the second conveyor motor MC2 when a predetermined time elapses after receiving the information from the second conveyor sensor SC2. In this case, the control unit 500 may control the rotational speed of the first conveyor motor MC1 and the rotational speed of the second conveyor motor MC2 so that a speed at which the first conveyor 320 transfers the garment and a speed at which the second conveyor 330 transfers the garment are equal to each other.

With this configuration, the first conveyor 320 and the second conveyor 330 may transfer the garment rearward, and the garment C may be folded while the tip portion and the rear end of the garment C are brought together. That is, according to the present disclosure, in the second conveyor transfer step S30, the lower edge folding may be performed on the garment C by changing the rotation direction of the second conveyor motor MC2 (see FIG. 13).

Meanwhile, when the second conveyor sensor SC2 detects the presence of the garment, the control unit 500 may operate the second conveyor movement motor MR and rotate the rear end of the second conveyor 330 downward by a predetermined angle $\alpha$. That is, when the second conveyor sensor SC2 detects the presence of the garment, the control unit 500 may enlarge the space between the first conveyor 320 and the second conveyor 330 and release the operation of pressing the garment C. With this configuration, it is possible to prevent the garment C from clumping during the lower edge folding process (see FIG. 14).

Meanwhile, in the second conveyor transfer step S30 or lower edge folding step S40, the control unit 500 may calculate a length of the garment. The control unit 500 may use the embedded timer (not illustrated) and measure the time after the presence of the garment C is detected in the loading step S10, and the control unit 500 may use the garment length calculation sensor SL2 and detect that the input of the garment ends. In this case, the control unit 500 may calculate the length of the garment C on the basis of the speed at which the loading conveyor 230 transfers the garment, the time elapsed after the presence of the garment C is detected, and a distance d between the garment input detection sensor SL1 and the garment length calculation sensor SL2. For example, the length of the garment C may be calculated by multiplying the speed, at which the loading conveyor 230 transfers the garment, by the time elapsed after the presence of the garment C is detected, and then adding the distance d between the garment input detection sensor SL1 and the garment length calculation sensor SL2.

With this configuration, the control unit 500 may calculate an overall length of the garment C and calculating a position, at which the garment C is horizontally folded, by using the overall length of the garment C.

After the lower edge folding step S40, the control unit 500 may operate the third conveyor 350 and transfer the garment C (S50).

Specifically, when the control unit 500 receives information, which indicates that the garment C has passed over the predetermined position on the second conveyor 330, from the second conveyor sensor SC2, the control unit 500 may operate the third conveyor motor MC3 and transfer the garment C having passed through the first conveyor 320 and the second conveyor 330. In this case, the control unit 500 may use the calculated length of the garment C and transfer the garment C to a horizontal folding position suitable for the corresponding garment C (see FIG. 15).

When the transfer (S50) of the garment C by the third conveyor 350 ends, the control unit 500 may operate the first folding plate drive motor MP1 and perform the vertical folding on the garment C (S60). In this case, the pair of first folding plates 360 may fold the garment C while rotating (see FIG. 16).

Further, when the vertical folding (S60) on the garment C ends, the control unit 500 may operate the second folding plate drive motor MP2 and perform the horizontal folding on the garment C (S70). In this case, the second folding plate 370 may fold the garment C while rotating (see FIG. 17).

Meanwhile, when the horizontal folding (S70) on the garment C ends, the control unit 500 may perform an unloading step S80.

In the unloading step S80, the control unit 500 may operate the third conveyor movement motor MU and rotate and move the front end of the third conveyor 350 downward. Specifically, when the third conveyor movement motor MU operates, the front end of the third conveyor 350 may move downward while defining an arc about the conveyor shaft 351 disposed at the rear side of the third conveyor 350. With this configuration, the garment C placed on the third conveyor 350 may be disposed to be inclined downward toward the unloading unit 400 (see FIG. 18).

In addition, in the unloading step S80, the control unit 500 may operate the third conveyor motor MC3 and transfer the garment C to the unloading unit 400. In this case, the rotation direction of the third conveyor motor MC3 may be opposite to the rotation direction of the third conveyor motor MC3 that transfers the garment to perform the horizontal folding. With this configuration, the garment C may be transferred to the unloading unit 400 along the third conveyor 350 (see FIG. 19).

While the present disclosure has been described with reference to the specific embodiments, the specific embodiments are only for specifically explaining the present disclosure, and the present disclosure is not limited to the specific embodiments. It is apparent that the present disclosure may be modified or altered by those skilled in the art without departing from the technical spirit of the present disclosure.

All the simple modifications or alterations to the present disclosure fall within the scope of the present disclosure, and the specific protection scope of the present disclosure will be defined by the appended claims.

The invention claimed is:

1. A garment folding machine comprising:
- a housing;
- a loading unit into which a garment is loaded; and
- a folding unit configured to transfer and fold the loaded garment,
- wherein the folding unit comprises:
- a first conveyor configured to transfer the garment from an upper side toward a lower side based on a gravitational direction;
- a second conveyor disposed below the first conveyor and having a rear end changeable in height; and
- a folding plate disposed rearward of the second conveyor and configured to fold the garment while rotating.

2. The garment folding machine of claim 1, wherein the loading unit comprises:
- a loading plate onto which the garment is loaded; and
- a loading conveyor provided above the loading plate and configured to transfer the garment rearward while rotating.

3. The garment folding machine of claim 2, wherein a speed at which the first conveyor transfers the garment is higher than a speed at which the loading conveyor transfers the garment.

4. The garment folding machine of claim 2, further comprising:
- a control unit configured to control the loading unit and the folding unit,
- wherein the loading unit comprises:
- a loading conveyor motor configured to provide driving power for operating the loading conveyor; and
- a garment input detection sensor disposed rearward of the loading plate and configured to detect the garment, and
- wherein the control unit operates the loading conveyor motor when the garment input detection sensor detects the garment.

5. The garment folding machine of claim 1, wherein a folding gap with a predetermined interval is formed between the first conveyor and the second conveyor, and a distance of the folding gap is smaller than a thickness of the garment.

6. The garment folding machine of claim 1, wherein the second conveyor transfers the garment forward, and
- wherein the garment is transferred rearward when the garment is moved to a predetermined direction change position.

7. The garment folding machine of claim 6, wherein the rear end of the second conveyor is rotated and moved downward when the garment is moved to the direction change position.

8. The garment folding machine of claim 1, wherein the folding unit comprises a third conveyor disposed rearward of the second conveyor and configured to transfer the garment having passed over the second conveyor.

9. The garment folding machine of claim 8, wherein a front end of the third conveyor is rotated and moved downward after the folding plate is rotated.

10. The garment folding machine of claim 1, further comprising:
- a control unit configured to control the loading unit and the folding unit,
- wherein the folding unit comprises:
- a first conveyor sensor disposed on the first conveyor and configured to detect the garment; and
- a second conveyor motor configured to provide driving power for operating the second conveyor, and
- wherein the control unit operates the second conveyor motor when the first conveyor sensor detects the garment.

11. The garment folding machine of claim 1, further comprising:
- a control unit configured to control the loading unit and the folding unit,
- wherein the folding unit comprises:
- a second conveyor motor configured to provide driving power for operating the second conveyor; and
- a second conveyor sensor disposed on the second conveyor and configured to detect the garment, and
- wherein the control unit changes a rotation direction of the second conveyor motor when the second conveyor sensor detects the garment.

12. The garment folding machine of claim 11, wherein the folding unit further comprises a second conveyor movement motor configured to rotate the second conveyor to rotate the rear end of the second conveyor, and
- wherein the control unit operates the second conveyor movement motor when the second conveyor sensor detects the garment.

13. A garment folding machine comprising:
- a housing;
- a loading unit into which a garment is loaded; and a folding unit configured to transfer and fold the loaded garment, wherein the folding unit comprises:

a first conveyor configured to transfer the garment from an upper side toward a lower side based on a gravitational direction; and a second conveyor disposed below the first conveyor and having a rear end changeable in height, and wherein the second conveyor folds the garment by changing a direction, in which the garment is transferred, while transferring the garment.

* * * * *